US009583064B2

(12) United States Patent
Wu

(10) Patent No.: US 9,583,064 B2
(45) Date of Patent: Feb. 28, 2017

(54) LIQUID CRYSTAL DISPLAY

(71) Applicant: AU Optronics Corp., Hsin-Chu (TW)

(72) Inventor: Ming-Hung Wu, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 113 days.

(21) Appl. No.: 14/559,935

(22) Filed: Dec. 4, 2014

(65) Prior Publication Data

US 2015/0212381 A1 Jul. 30, 2015

(30) Foreign Application Priority Data

Jan. 28, 2014 (TW) ..... 103103244 A

(51) Int. Cl.
*G09G 3/18* (2006.01)
*G09G 3/36* (2006.01)

(52) U.S. Cl.
CPC ..... *G09G 3/3677* (2013.01); *G09G 3/3614* (2013.01); *G09G 3/3655* (2013.01); *G09G 3/3611* (2013.01); *G09G 3/3648* (2013.01); *G09G 2300/0809* (2013.01); *G09G 2310/0286* (2013.01); *G09G 2310/0291* (2013.01)

(58) Field of Classification Search
CPC ..... G09G 3/36; G09G 3/3611; G09G 3/3614; G09G 3/3648; G09G 3/3655; G09G 3/3674; G09G 3/3677; G09G 2300/0809; G09G 2310/0286; G09G 2310/0291
See application file for complete search history.

(56) References Cited

U.S. PATENT DOCUMENTS 3,558,828 A * 1/1971 Marty ..... H04Q 3/54591 379/384
5,673,059 A * 9/1997 Zavracky ..... G02B 27/017 345/8
5,684,503 A * 11/1997 Nomura ..... G09G 3/3629 345/94
5,684,504 A * 11/1997 Verhulst ..... G09G 3/3651 345/95
5,892,504 A * 4/1999 Knapp ..... G09G 3/367 345/204
6,097,352 A * 8/2000 Zavracky ..... G02B 27/017 345/7
6,335,721 B1 * 1/2002 Jeong ..... G09G 3/3614 345/100
6,411,272 B1 * 6/2002 Edwards ..... G02F 1/134336 257/350

(Continued)

*Primary Examiner* — Michael J Eurice
(74) *Attorney, Agent, or Firm* — WPAT, LLC; Justin King

(57) ABSTRACT

A liquid crystal display (LCD) has a pixel matrix, a plurality of shift registers, a plurality of common voltage generators, a plurality of common voltage buffers, and a plurality of primary bidirectional switch circuits. The shift registers sequentially output gate signals to scan lines of the pixel matrix. The common voltage generators output initial common voltages according to the gate signals. The common voltage buffers are configured to buffer the initial common voltages to output a plurality of common voltages to a plurality of common voltage lines of the pixel matrix. Each of the primary bidirectional switch circuits is configured to control electrical connection between two of the common voltage lines according to one or more gate signals outputted from at least one of the shift registers.

15 Claims, 22 Drawing Sheets

(56) References Cited

U.S. PATENT DOCUMENTS 6,452,580 B1* 9/2002 Edwards ..... G09G 3/3648 345/100
6,469,684 B1* 10/2002 Cole ..... G09G 3/3614 345/58
6,700,562 B1* 3/2004 Knapp ..... G09G 3/3688 345/103
6,778,626 B2 8/2004 Yu
7,136,041 B2 11/2006 Park
7,342,562 B2 3/2008 Kawase
7,379,058 B2 5/2008 Toyozawa
7,756,238 B2 7/2010 Chen
2001/0010512 A1* 8/2001 Azami ..... G09G 3/20 345/100
2001/0033254 A1* 10/2001 Furusato ..... G06F 3/0414 345/55
2001/0054989 A1* 12/2001 Zavracky ..... G02B 27/017 345/8
2002/0030659 A1* 3/2002 Zavracky ..... G09G 3/3611 345/99
2002/0067327 A1* 6/2002 Ozawa ..... G09G 3/3648 345/89
2002/0186196 A1* 12/2002 Park ..... G09G 3/3677 345/100
2004/0052327 A1* 3/2004 Yu ..... G11C 19/28 377/64
2004/0130544 A1* 7/2004 Sun ..... G09G 3/3648 345/211
2004/0156246 A1* 8/2004 Nakamura ..... G09G 3/3611 365/199
2004/0196232 A1* 10/2004 Kim ..... G09G 3/3614 345/89
2004/0263446 A1* 12/2004 Kawase ..... G09G 3/3655 345/87
2005/0057465 A1* 3/2005 Yu ..... G09G 3/3655 345/87
2006/0109229 A1* 5/2006 Iwabuchi ..... G09G 3/3688 345/98
2006/0132425 A1* 6/2006 Kim ..... G02F 1/13452 345/104
2006/0152460 A1* 7/2006 Toyozawa ..... G09G 3/3648 345/98
2006/0158409 A1* 7/2006 Shi ..... G09G 3/3648 345/87
2007/0013643 A1* 1/2007 Hong ..... G09G 3/3648 345/100
2007/0018919 A1* 1/2007 Zavracky ..... G09G 3/3406 345/87
2007/0046601 A1* 3/2007 Shin ..... G09G 3/3607 345/89
2007/0080905 A1* 4/2007 Takahara ..... G09G 3/3233 345/76
2007/0080913 A1* 4/2007 Park ..... G09G 3/006 345/87
2007/0109249 A1* 5/2007 Lee ..... G09G 3/3666 345/100
2007/0241952 A1* 10/2007 Kim ..... G09G 3/20 341/144
2008/0024471 A1* 1/2008 Park ..... G09G 3/006 345/204
2008/0079001 A1* 4/2008 Umezaki ..... H01L 27/1251 257/59
2008/0079701 A1* 4/2008 Shin ..... G09G 3/3677 345/204
2008/0150852 A1* 6/2008 Edwards ..... G09G 3/3648 345/87
2008/0284695 A1* 11/2008 Kato ..... G09G 3/3614 345/87
2009/0027318 A1* 1/2009 Murakami ..... G09G 3/20 345/87
2009/0262884 A1* 10/2009 Chen ..... G11C 19/18 377/64
2010/0039425 A1* 2/2010 Chen ..... G09G 3/36 345/214
2010/0097369 A1* 4/2010 Fujita ..... G09G 3/3614 345/213
2013/0088479 A1* 4/2013 Kim ..... G09G 3/3614 345/212
2013/0100105 A1* 4/2013 Furuta ..... G09G 3/3648 345/211
2014/0340600 A1* 11/2014 Yokonuma ..... G09G 3/3614 349/33

* cited by examiner

LIQUID CRYSTAL DISPLAY

BACKGROUND OF THE INVENTION

1. Field of the Invention

The present invention is related to a liquid crystal display, and more particularly to a liquid crystal display capable of sharing electric charge of common voltage lines thereof.

2. Description of the Prior Art

Liquid crystal displays (LCDs) are the most popular displays nowadays. Due to the properties of lightweight, low energy consumption, and free of radiation emission, LCDs have gradually replaced the cathode ray tube (CRT) monitors of conventional personal computers and have been widely-used in many portable information products, such as notebooks, personal digital assistants (PDAs), etc.

Due to the vigorous development of smart phones, customer demand for small-sized display panels with a narrow bezel and high resolution design is increasing. However, high resolution results in a greater load of the common voltage circuits of the display panel, such that it is required to increase the size of common voltage buffers of the display panel to improve the current driving capability thereof for feeding a greater load. Since large-sized common voltage buffers require a greater layout area, it is difficult to achieve a narrow bezel design of the display panel.

SUMMARY OF THE INVENTION

An embodiment of the present invention provides a liquid crystal display (LCD). The LCD comprises a pixel matrix, a plurality of shift registers, a plurality of common voltage generators and a plurality of primary bidirectional switch circuits. The pixel matrix comprises a plurality of pixels, a plurality of scan lines and a plurality of common voltage lines. The pixels are arranged in a plurality of rows. Each of the scan lines is coupled to pixels arranged in one of the rows. Each of the common voltage lines is coupled to the pixels arranged in one of the rows. The shift registers are coupled to the scan lines and configured to sequentially output gate signals to the scan lines. The common voltage generators are coupled between the shift registers and the common voltage lines and configured to output initial common voltages according to the gate signals. The primary bidirectional switch circuits are coupled to the shift registers and the common voltage lines. Each of the primary bidirectional switch circuits is configured to control electrical connection between two of the common voltage lines according to at least one of the gate signals output from the shift registers.

According to the embodiments of the present invention, with the help of primary bidirectional switch circuits, the LCD may control electrical connections of the common voltage lines according to timing of polarity inversion of each row of pixel. Accordingly, electric charge of each common voltage line may be shared to other common voltage lines, and an equivalent capacitance of pixels driven by the common voltage buffers may be not too great. Since the equivalent capacitance of pixels driven by the common voltage buffers may be not too great, the layout area of the common voltage buffers may be reduced to contribute to the achievement of a narrow bezel design of the display panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
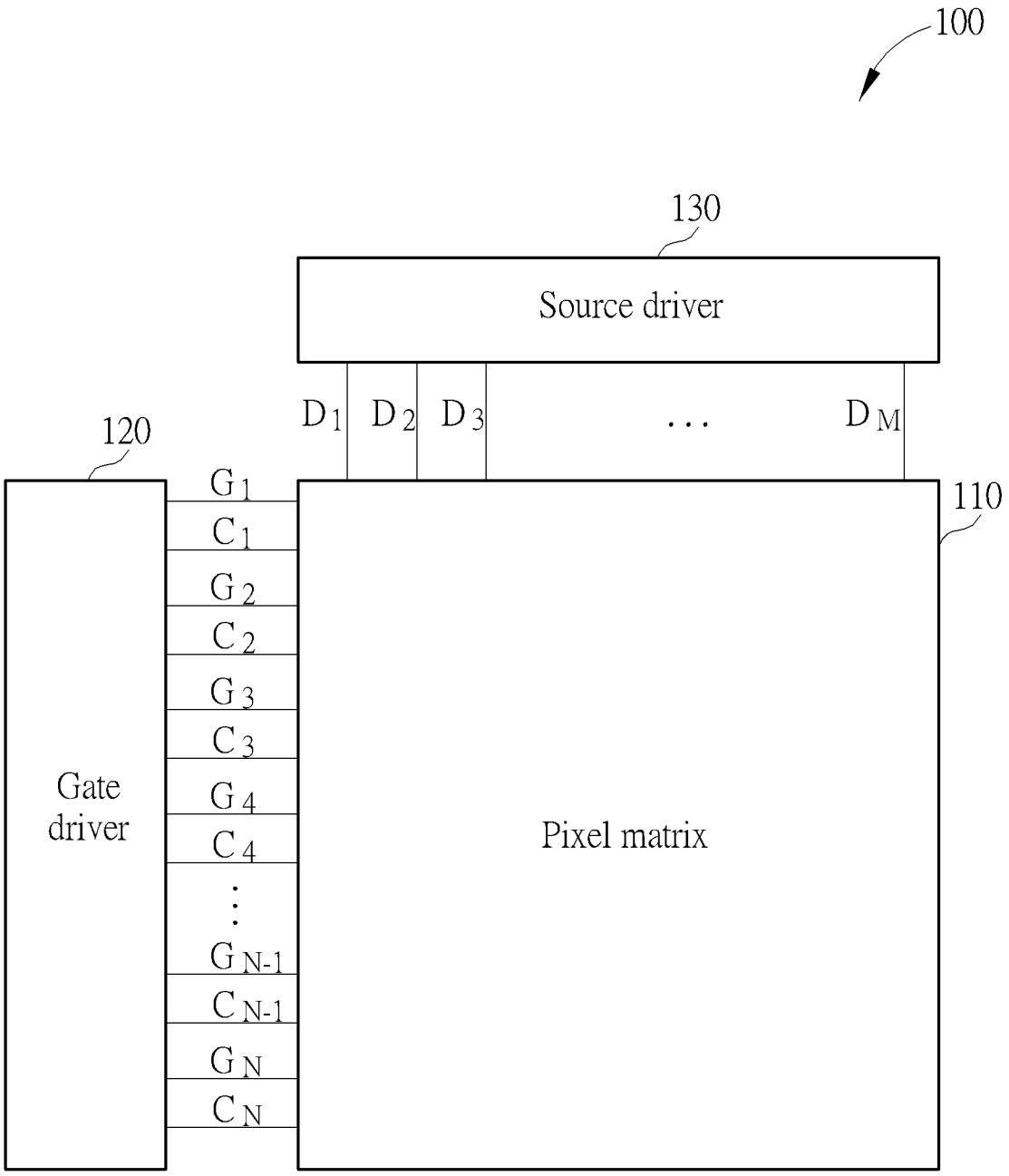
FIG. 1 is a schematic diagram of a liquid crystal display according to an embodiment of the present invention.
Figure 2:
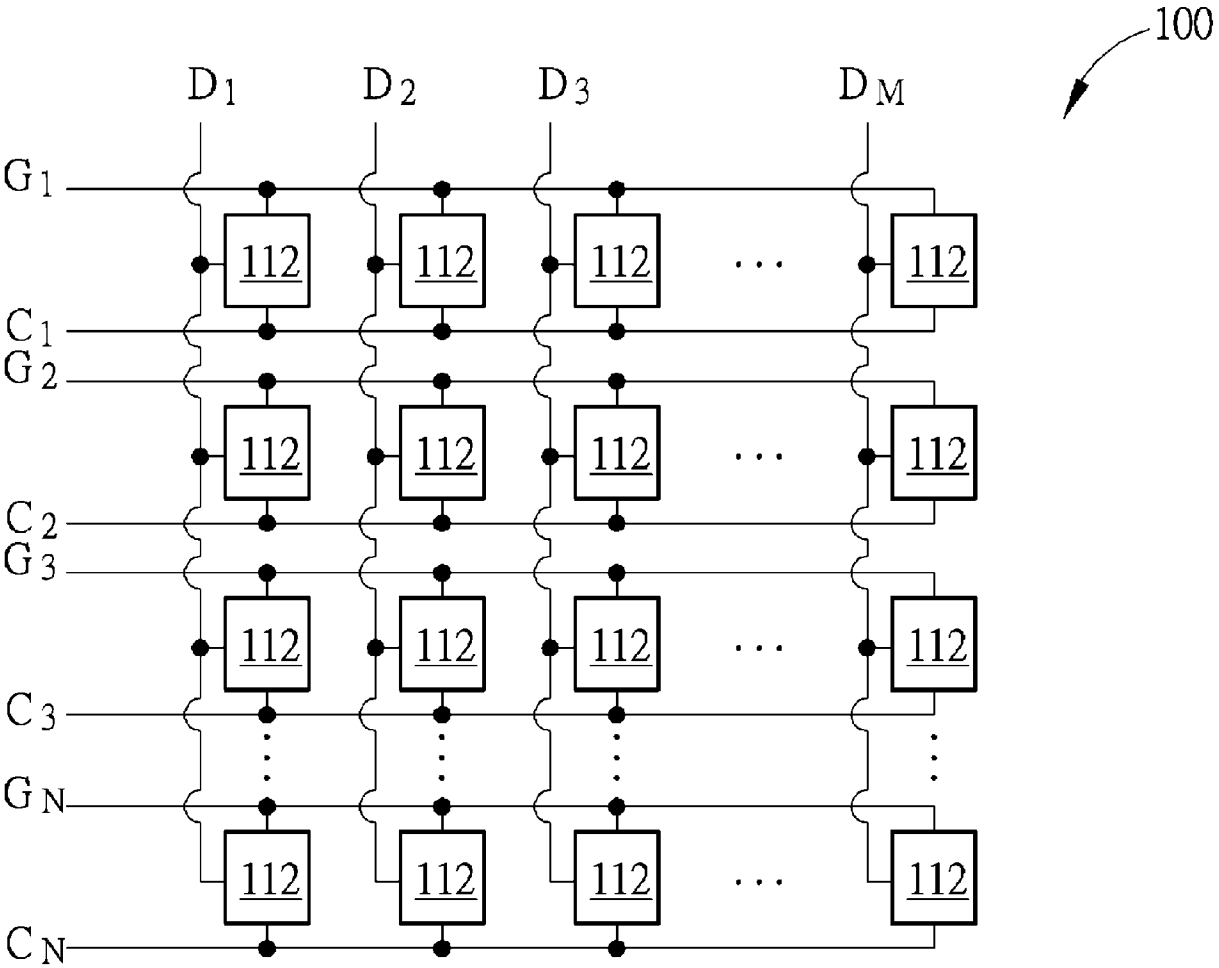
FIG. 2 is a schematic diagram of a pixel matrix in FIG. 1.
Figure 3:
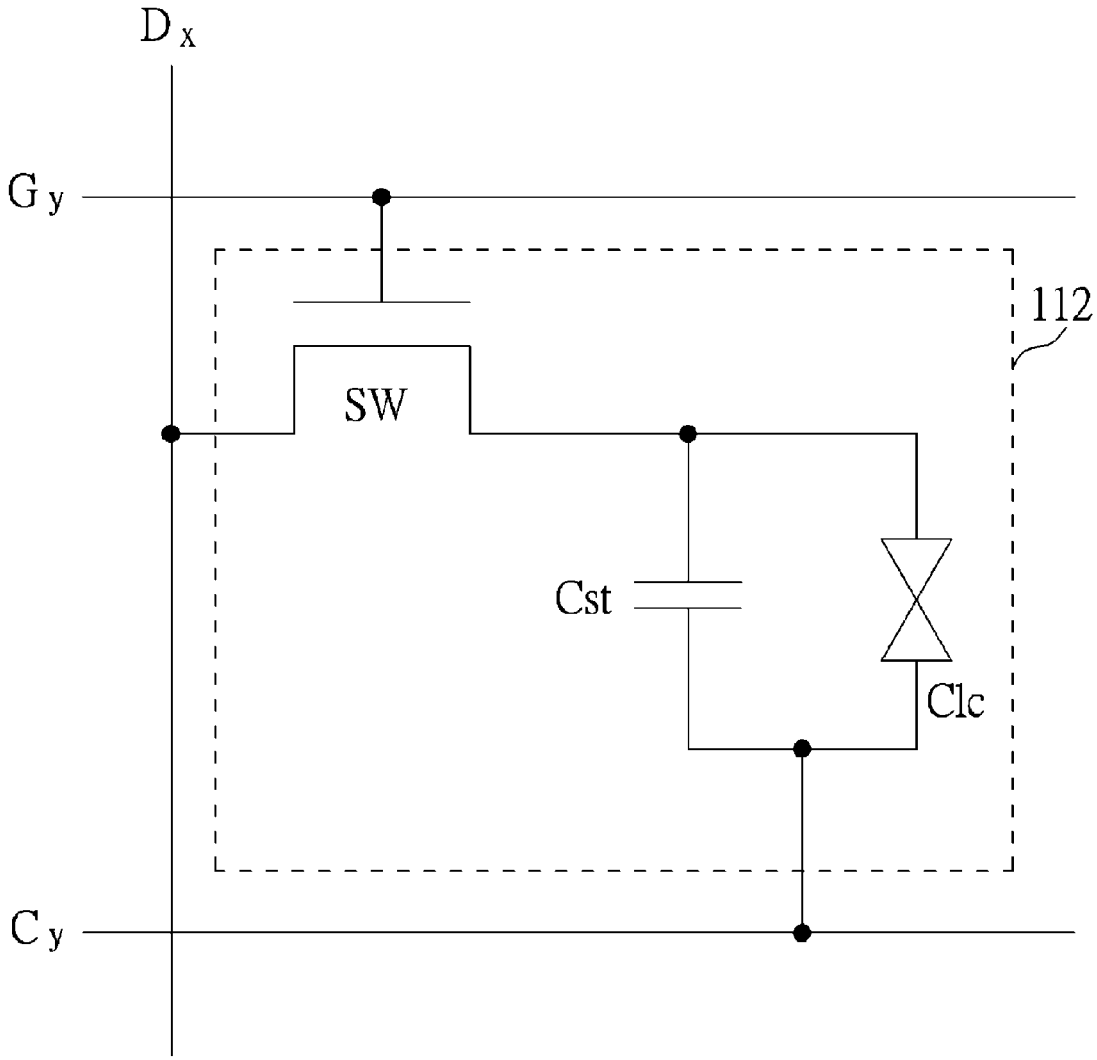
FIG. 3 is a circuit diagram of a pixel in FIG. 2.

Please refer to FIGS. 1 to 3. FIG. 1 is a schematic diagram of a liquid crystal display 100 according to an embodiment of the present invention. FIG. 2 is a schematic diagram of a pixel matrix 110 in FIG. 1. FIG. 3 is a circuit diagram of a pixel 112 in FIG. 2. The liquid crystal display 100 comprises the pixel matrix 110, a gate driver 120 and a source driver 130. The pixel matrix 110 comprises a plurality of pixels 112, a plurality of scan lines $G_1$ to $G_N$, a plurality of common voltage lines $C_1$ to $C_N$ and a plurality of data lines $D_1$ and $D_M$. The pixels 112 are arranged in N rows and M columns, where M and N are positive integers. Each of the scan lines $G_1$ to $G_N$ is coupled to the pixels 112 arranged in one of the rows, and each of the common voltage lines $C_1$ to $C_N$ is coupled to the pixels 112 arranged in one of the rows. Each of the pixels 112 has a switch SW, a storage capacitor Cst and a liquid crystal capacitor Clc. The switch SW may be a thin film transistor (TFT). Each of the pixels 112 is coupled to a data line $D_x$, a scan line $G_y$ and a common voltage line $C_y$, where x and y are positive integers, $1 \leq x \leq M$, and $1 \leq y \leq N$. The switch SW is turned on/off based on a voltage level of the scan line $G_y$. When the switch SW is turned on, the data line $D_x$ charges the storage capacitor Cst and the liquid crystal capacitor Clc of the pixel 112 through the switch SW. A voltage level of the common voltage line $C_y$ is switched once between a high voltage level and a low voltage level within a frame period. It should be noted that the circuit structure of the pixel 112 in FIG. 3 is merely an example used in the present invention, and the present invention is not limited thereto. In other words, the pixel 112 may have different circuit structures in other embodiments of the present invention.

Figure 4:
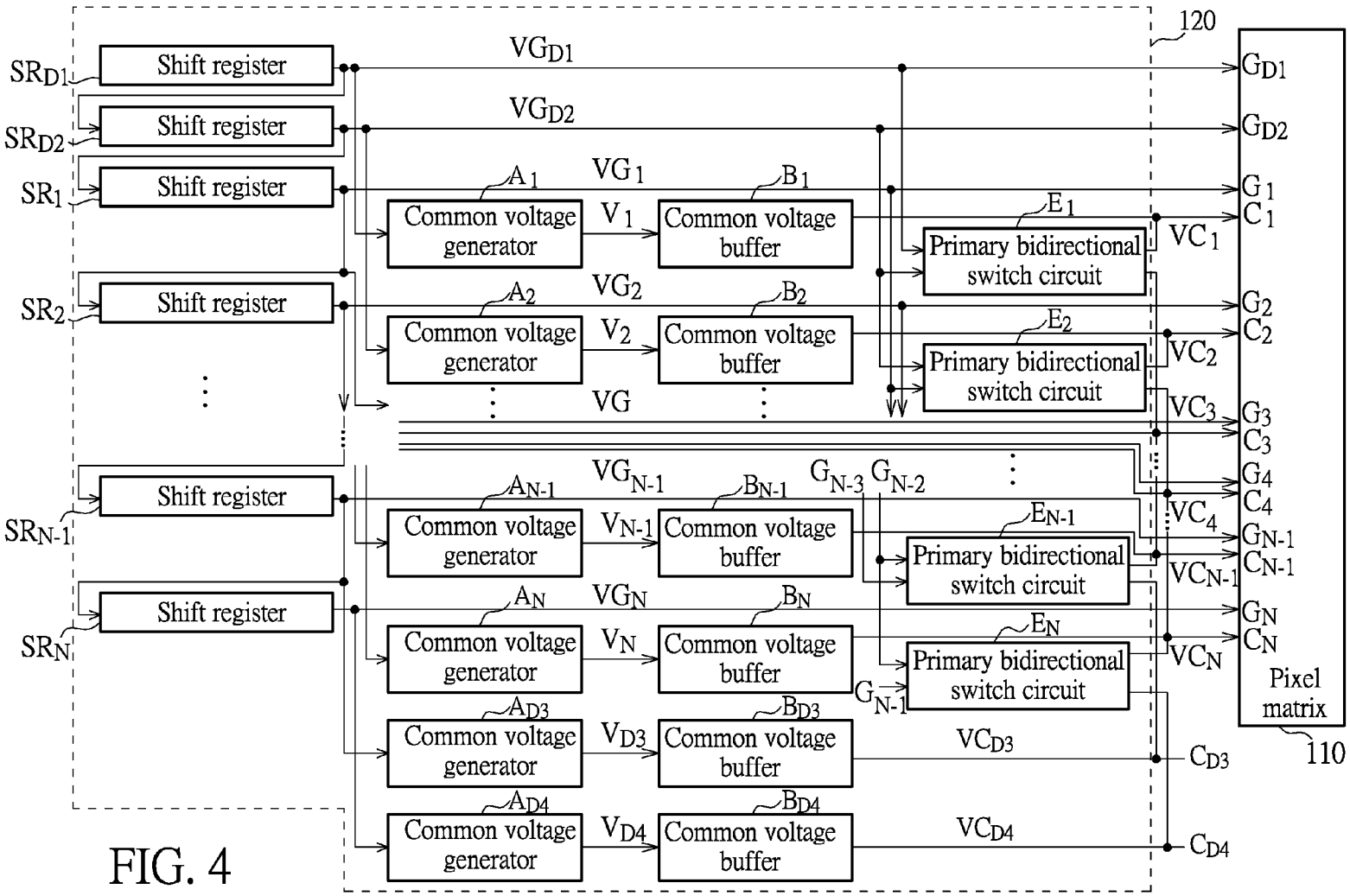
FIG. 4 is a schematic diagram of the pixel matrix and a gate driver in FIG. 1.

Please refer to FIG. 4. FIG. 4 is a schematic diagram of the pixel matrix 110 and the gate driver 120 in FIG. 1. The gate driver 120 has a plurality of shift registers $SR_{D1}$, $SR_{D2}$ and $SR_1$ to $SR_N$, a plurality of common voltage generators $A_1$ to $A_N$, $A_{D3}$ and $A_{D4}$ and a plurality of primary bidirectional switch circuits $E_1$ to $E_N$. The shift registers $SR_{D1}$, $SR_{D2}$ and $SR_1$ to $SR_N$ are coupled to the scan lines $G_{D1}$, $G_{D2}$ and $G_1$ to $G_N$ and are configured to sequentially output gate signals $VG_{D1}$, $VG_{D2}$ and $VG_1$ to $VG_N$ to the scan lines $G_{D1}$, $G_{D2}$ and $G_1$ to $G_N$. The first one shift register $SR_{D1}$ and the second one shift register $SR_{D2}$ are dummy shift registers, and the scan lines $G_{D1}$ and $G_{D2}$ are dummy scan lines and not directly coupled to any of the pixels 112. The common voltage generators $A_1$ to $A_N$, $A_{D3}$ and $A_{D4}$ are coupled between the shift registers $SR_{D1}$, $SR_{D2}$ and $SR_1$ to $SR_N$ and the common voltage lines $C_1$ to $C_N$, $C_{D3}$ and $C_{D4}$. The common voltage generators $A_1$ to $A_N$, $A_{D3}$ and $A_{D4}$ are configured to output initial common voltages $V_1$ to $V_N$, $V_{D3}$ and $V_{D4}$ according to the gate signals $VG_{D1}$, $VG_{D2}$ and $VG_1$ to $VG_N$. The primary bidirectional switch circuits $E_1$ to $E_N$ are coupled to the shift registers $SR_{D1}$, $SR_{D2}$ and $SR_1$ to $SR_N$ and the common voltage lines $C_1$ to $C_N$, $C_{D3}$ and $C_{D4}$. The common voltage generators $A_{D3}$ and $A_{D4}$ are dummy common voltage generators, and the common voltage lines $C_{D3}$ and $C_{D4}$ are dummy common voltage lines.

In an embodiment of the present invention, the output ends of the common voltage generators $A_{D3}$ and $A_{D4}$ are electrically coupled to the common voltage lines $C_1$ to $C_N$, $C_{D3}$ and $C_{D4}$ so as to directly apply the initial common voltages $V_1$ to $V_N$, $V_{D3}$ and $V_{D4}$ to the common voltage lines $C_1$ to $C_N$, $C_{D3}$ and $C_{D4}$. In an embodiment of the present invention, the gate driver 120 further comprises a plurality of common voltage buffers $B_1$ to $B_N$, $B_{D3}$ and $B_{D4}$ coupled between the common voltage generators $A_1$ to $A_N$, $A_{D3}$ and $A_{D4}$ and the common voltage lines $C_1$ to $C_N$, $C_{D3}$ and $C_{D4}$. The common voltage buffers $B_1$ to $B_N$, $B_{D3}$ and $B_{D4}$ are configured to buffer the initial common voltages $V_1$ to $V_N$, $V_{D3}$ and $V_{D4}$ so as to output a plurality of common voltages $VC_1$ to $VC_N$, $VC_{D3}$ and $VC_{D4}$ to the common voltage lines $C_1$ to $C_N$, $C_{D3}$ and $C_{D4}$. The common voltage buffers $B_{D3}$ and $B_{D4}$ are dummy common voltage buffers.

Figure 5:
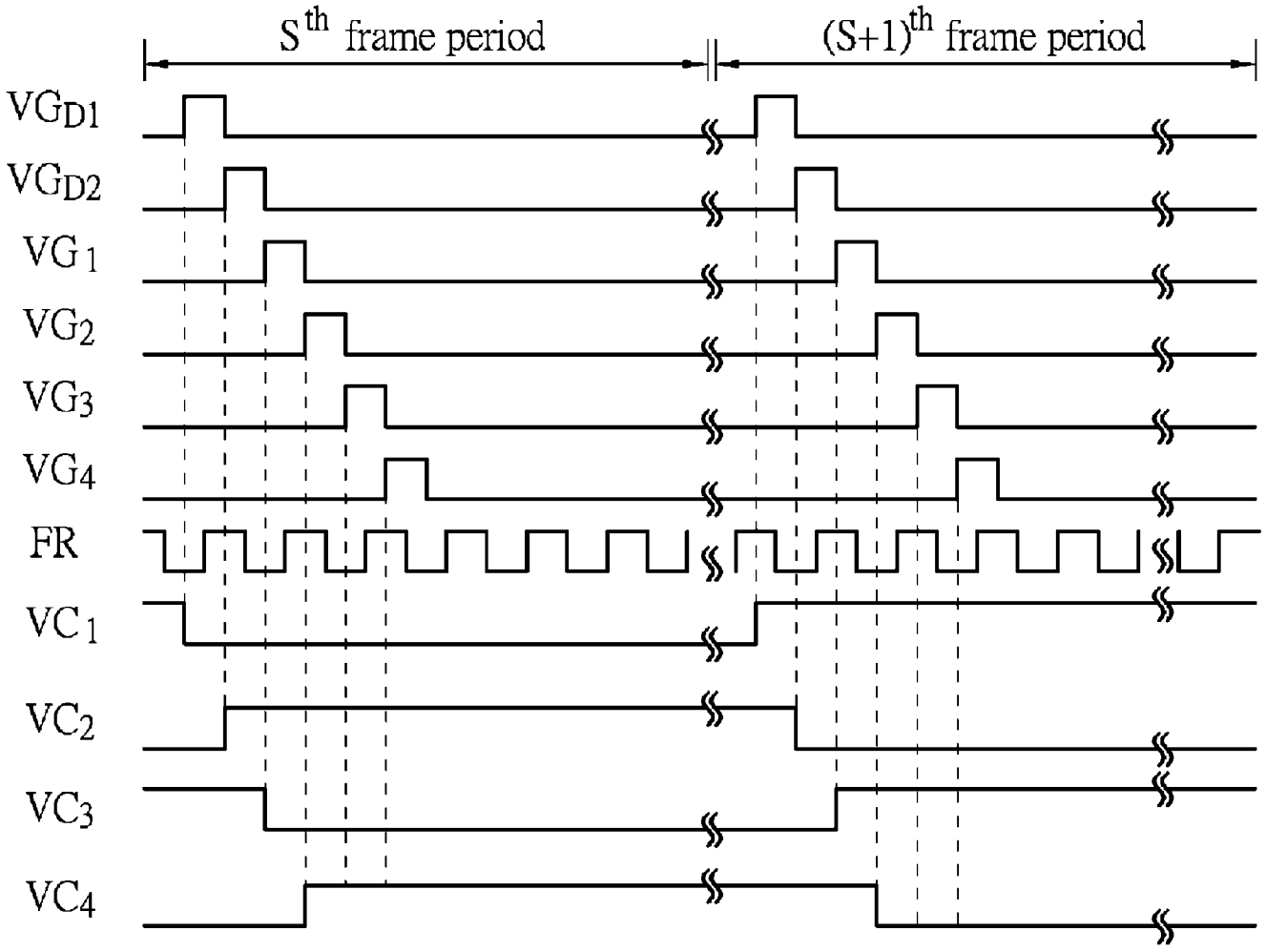
FIG. 5 is a timing diagram of the liquid crystal display in FIG. 1.

In an embodiment of the present invention, the LCD 100 changes the polarities of the pixels 112 with row inversion. Please refer FIG. 5 with reference of FIG. 4. FIG. 5 is a timing diagram of the liquid crystal display 100 in FIG. 1. Within an $S^{th}$ frame period, odd-numbered common voltages (e.g. $VC_1$, $VC_3$, $VC_{D3}$) are pulled down from a high voltage level to a low voltage level, and even-numbered common voltages (e.g. $VC_2$, $VC_4$, $VC_{D4}$) are pulled up from the low voltage level to the high voltage level. Within an $S+1^{th}$ frame period, odd-numbered common voltages (e.g. $VC_1$, $VC_3$, $VC_{D3}$) are pulled up from the low voltage level to the high voltage level, and even-numbered common voltages (e.g. $VC_2$, $VC_4$, $VC_{D4}$) are pulled down from the high voltage level to the low voltage level. The parameter S is a positive integer. Moreover, within each frame period of the LCD 100, the gate signals $VG_{D1}$, $VG_{D2}$ and $VG_1$ to $VG_N$ are sequentially pulled up from the low voltage level to the high voltage level. Moreover, the gate driver 120 of the LCD 100 generates the common voltages $VC_1$ to $VC_N$, $VC_{D3}$ and $VC_{D4}$ according to the voltage levels of a clock signal FR and the gate signals $VG_{D1}$, $VG_{D2}$ and $VG_1$ to $VG_N$. The voltage level of each of the common voltages $VC_1$ to $VC_N$ is switched two scan periods before the corresponding one of the gate signals $VG_{D1}$ to $VG_N$ is pulled up from the low voltage level to the high voltage level. For example, two scan periods before the gate signal $VG_1$ is pulled up from the low voltage level to the high voltage level (i.e. when the gate signal $VG_{D1}$ is pulled up from the low voltage level to the high voltage level), the voltage level the common voltage $VC_1$ is switched. Two scan periods before the gate signal $VG_2$ is pulled up from the low voltage level to the high voltage level (i.e. when the gate signal $VG_{D2}$ is pulled up from the low voltage level to the high voltage level), the voltage level the common voltage $VC_2$ is switched. Two scan periods before the gate signal $VG_3$ is pulled up from the low voltage level to the high voltage level (i.e. when the gate signal $VG_1$ is pulled up from the low voltage level to the high voltage level), the voltage level the common voltage $VC_3$ is switched. The rest may be deduced by analogy. Moreover, the voltage level the common voltage $VC_{D3}$ is switched when the gate signal $VG_{N-1}$ is pulled up from the low voltage level to the high voltage level. The voltage level the common voltage $VC_{D4}$ is switched when the gate signal $VG_N$ is pulled up from the low voltage level to the high voltage level.

Please refer to FIG. 4 again. Each of the primary bidirectional switch circuits $E_1$ to $E_N$ is configured to control electrical connection between two of the common voltage lines $C_1$ to $C_N$, $C_{D3}$ and $C_{D4}$ according to two of the gate signals output from two of the shift registers $SR_{D1}$, $SR_{D2}$ and $SR_1$ to $SR_N$. For example, in an embodiment of the present invention, the primary bidirectional switch circuit $E_1$ is configured to control electrical connection between the common voltage lines $C_1$ and $C_2$ according to the gate signals $VG_{D1}$ and $VG_{D2}$ output from the shift registers $SR_{D1}$ and $SR_{D2}$. The primary bidirectional switch circuit $E_2$ is configured to control electrical connection between the common voltage lines $C_2$ and $C_3$ according to the gate signals $VG_{D2}$ and $VG_1$ output from the shift registers $SR_{D2}$ and $SR_1$. The primary bidirectional switch circuit $E_{N-1}$ is configured to control electrical connection between the common voltage lines $C_{N-1}$ and $C_{D3}$ according to the two gate signals which two of shift registers $SR_{D1}$, $SR_{D2}$, $SR_1$ to $SR_N$ apply to the gate lines $G_{N-2}$ and $G_{N-3}$. The primary bidirectional switch circuit $E_N$ is configured to control electrical connection between the common voltage lines $C_N$ and $C_{D4}$ according to the two gate signals which two of shift registers $SR_{D1}$, $SR_{D2}$, $SR_1$ to $SR_N$ apply to the gate lines $G_{N-1}$ and $G_{N-2}$. Accordingly, electric charge may be shared among the common voltage lines $C_1$ to $C_N$, $C_{D3}$ and $C_{D4}$ via the primary bidirectional switch circuits $E_1$ to $E_N$.

Figure 6:
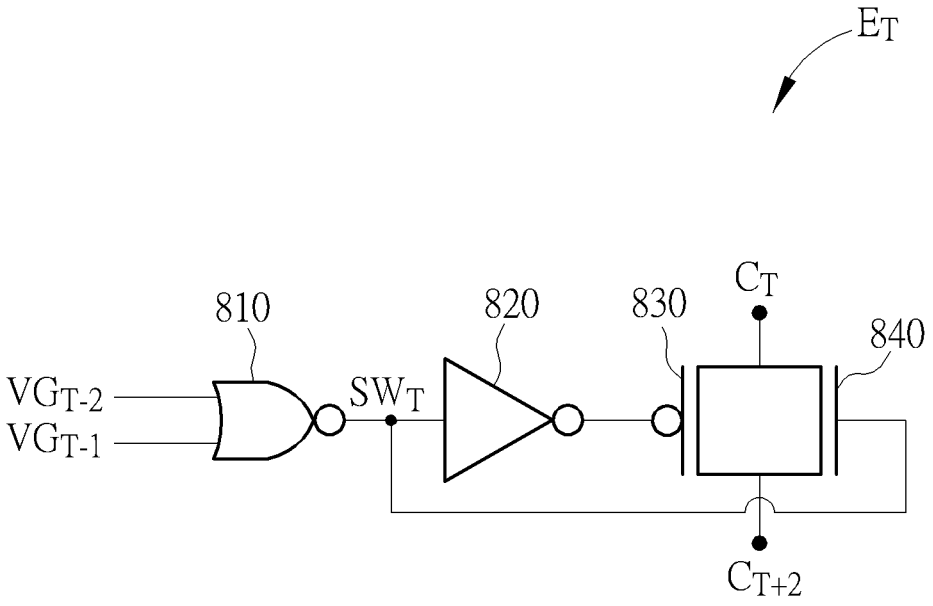
FIG. 6 is a circuit diagram of a primary bidirectional switch circuit in FIG. 4.

Please refer to FIG. 6 and FIG. 4. FIG. 6 is a circuit diagram of a primary bidirectional switch circuit $E_T$ in FIG. 4, where T is a positive integer, and $1 \leq T \leq N$. The primary bidirectional switch circuit $E_T$ comprises a NOR gate 810, an inverter 820, a first switch 830 and a second switch 840. The NOR gate 810 has two input ends for receiving the two gate signals $VG_{T-2}$ and $VG_{T-1}$ output from the two shift registers $SR_{T-2}$ and $SR_{T-1}$. The NOR gate 810 is configured to perform a logic NOR operation on the two gate signals $VG_{T-2}$ and $VG_{T-1}$ so as to output a signal $SW_T$. Regarding the primary bidirectional switch circuit $E_1$ (i.e. T=1), the two shift registers $SR_{T-2}$ and $SR_{T-1}$ are $SR_{D1}$ and $SR_{D2}$, and the two gate signals $VG_{T-2}$ and $VG_{T-1}$ received by the NOR gate 810 are $VG_{D1}$ and $VG_{D2}$. Regarding the primary bidirectional switch circuit $E_2$ (i.e. T=2), the two shift registers $SR_{T-2}$ and $SR_{T-1}$ are $SR_2$ and $SR_1$, and the two gate signals $VG_{T-2}$ and $VG_{T-1}$ received by the NOR gate 810 are $VG_{D2}$ and $VG_1$. Moreover, an input end of the inverter 820 is coupled to the output end of the NOR gate 810. A first end of the first switch 830 is coupled to a common voltage line $C_T$, a second end of the first switch 830 is coupled to a common voltage line $C_{T+2}$, and a control end of the first switch 830 is coupled to the output end of the inverter 820. A first end of the second switch 840 is coupled to the first end of the first switch 830 and the common voltage line $C_T$, a second end of the second switch 840 is coupled to the second end of the first switch 830 and the common voltage line $C_{T+2}$, and a control end of the second switch 840 is coupled to the output end of the NOR gate 810. Therefore, when one of the gate signals $VG_{T-2}$ and $VG_{T-1}$ is at the high voltage level, the first switch 830 and the second switch 840 are turned off, and the common voltage lines $C_T$ and $C_{T+2}$ are electrically disconnected. When the gate signals $VG_{T-2}$ and $VG_{T-1}$ are at the low voltage level, the first switch 830 and the second switch 840 are turned on, and the common voltage lines $C_T$ and $C_{T+2}$ are electrically connected. In other words, the $T^{th}$ primary bidirectional switch circuit $E_T$ controls the electrical connection between the $T^{th}$ common voltage line $C_T$ and the $T+2^{th}$ common voltage line $C_{T+2}$ of the common voltage lines $C_1$ to $C_N$, $C_{D3}$ and $C_{D4}$ according to the two gate signals $VG_{T-2}$ and $VG_{T-1}$ output from the $T^{th}$ shift register $SR_{T-2}$ and the $T+1^{th}$ shift register $SR_{T-1}$ of the shift registers $SR_{D1}$, $SR_{D2}$ and $SR_1$ to $SR_N$. Wherein, the first one of the shift registers is $SR_{D1}$, the second one of the shift registers is $SR_{D2}$, the third one of the shift registers is $SR_1$, the fourth one of the shift registers is $SR_2$, and so on. Therefore, the common voltage lines $C_T$ and $C_{T+2}$ share electric charge through the primary bidirectional switch circuit $E_T$. For example, the common voltage lines $C_1$ and $C_3$ share electric charge through the primary bidirectional switch circuit $E_1$. The common voltage lines $C_2$ and $C_4$ share electric charge through the primary bidirectional switch circuit $E_2$. Moreover, regarding the primary bidirectional switch circuit $E_{N-1}$ (i.e. T=N−1), the two common voltage lines $C_T$ and $C_{T+2}$ are the common voltage lines $C_{N-1}$ and $C_{D3}$. Regarding the primary bidirectional switch circuit $E_N$ (i.e. T=N), the two common voltage lines $C_T$ and $C_{T+2}$ are the common voltage lines $C_N$ and $C_{D4}$. Further, an equivalent capacitance of the pixels 112 driven by the common voltage lines $C_T$ and $C_{T+2}$ when the common voltage lines $C_T$ and $C_{T+2}$ are electrically connected is less than that when the common voltage lines $C_T$ and $C_{T+2}$ are electrically disconnected. The primary bidirectional switch circuit $E_T$ may be any one of the primary bidirectional switch circuits $E_1$ to $E_N$, and the common voltage lines $C_1$ to $C_N$ are driven by the common voltage buffers $B_1$ to $B_N$. Accordingly, due to the primary bidirectional switch circuits $E_1$ to $E_N$, an equivalent capacitance of the pixels 112 driven by the common voltage buffers $B_1$ to $B_N$ in FIG. 4 may be not too great. Therefore, the layout area of the common voltage buffers $B_1$ to $B_N$ may be reduced to contribute to the achievement of the narrow bezel design of the display panel.

Figure 7:
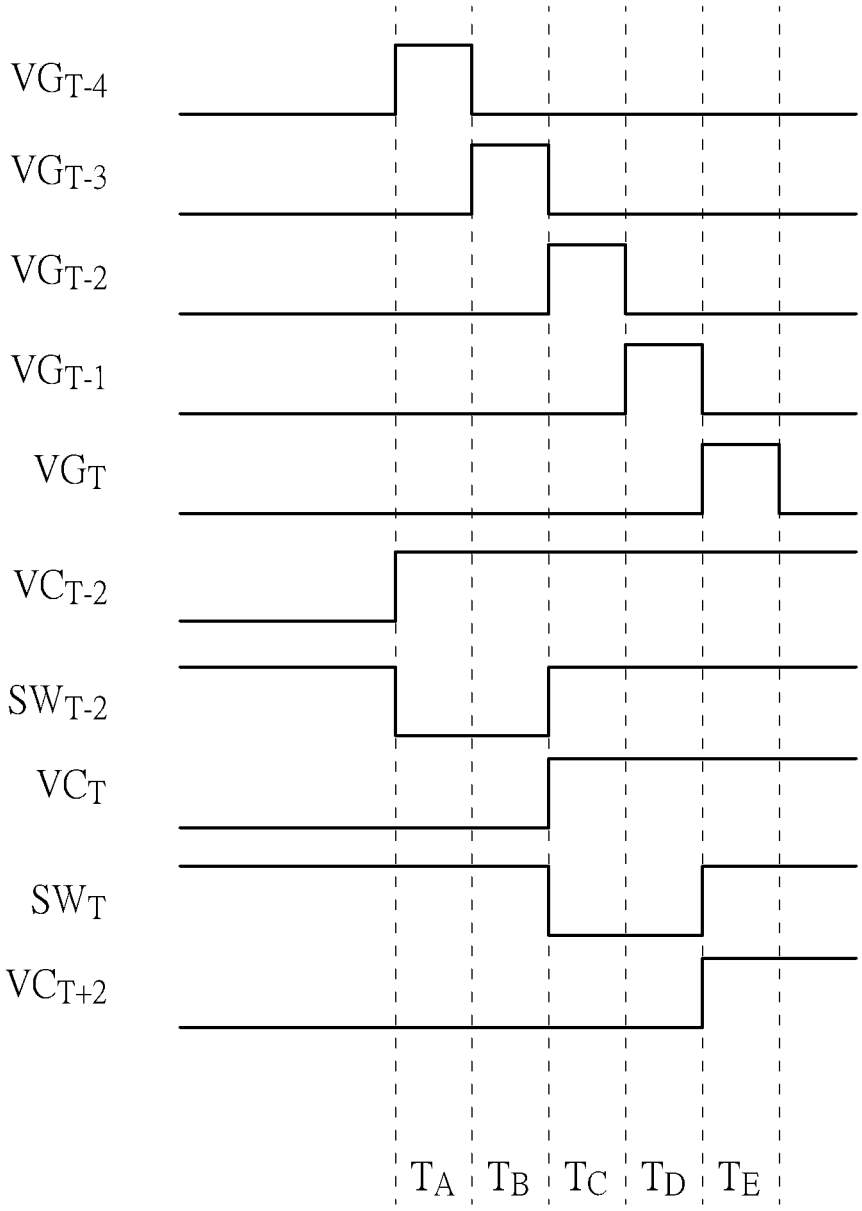
FIG. 7 is a timing diagram of the primary bidirectional switch circuit in FIG. 6.

Please refer to FIG. 7 and FIG. 6. FIG. 7 is a timing diagram of the primary bidirectional switch $E_T$ in FIG. 6. The voltage levels of the gate lines $VG_{T-4}$ to $VG_T$ are sequentially at the high voltage level within the durations $T_A$ to $T_E$, and the common voltages $VC_{T-2}$, $VC_T$ and $VC_{T+2}$ are pulled up from the low voltage level to the high voltage level respectively while the gates signals $VG_{T-4}$, $VG_{T-2}$ and $VG_T$ are pulled up to the high voltage level. Within the durations $T_C$ and $T_D$, the common voltages $VC_T$ and $VC_{T+2}$ are at different voltage levels, such that it is not proper to share electric charge between the common voltage lines $C_T$ and $C_{T+2}$. Therefore, the primary bidirectional switch $E_T$ in FIG. 6 should electrically disconnect the common voltage line $C_T$ from the common voltage line $C_{T+2}$ within the durations $T_C$ and $T_D$. As shown in FIGS. 6 and 7, since the ate lines $VG_{T-2}$ to $VG_{T-1}$ are not both at the low voltage level within the durations $T_C$ and $T_D$, the signal $SW_T$ is at the low voltage level, such that the common voltage lines $C_T$ and $C_{T+2}$ are electrically disconnected within the durations $T_C$ and $T_D$. Accordingly, when the common voltages $VC_T$ and $VC_{T+2}$ are at different voltage levels, the sharing of electric charge between the common voltage lines $C_T$ and $C_{T+2}$ is paused. In the same way, the signal $SW_{T-2}$ is at the low voltage level within the durations $T_A$ and $T_B$, such that the common voltage lines $C_{T-2}$ and $C_T$ are electrically disconnected within the durations $T_A$ and $T_B$. Therefore, when the common voltages $VC_{T-2}$ and $VC_T$ are at different voltage levels, the sharing of electric charge between the common voltage lines $C_{T-2}$ and $C_T$ is paused.

Figure 8:
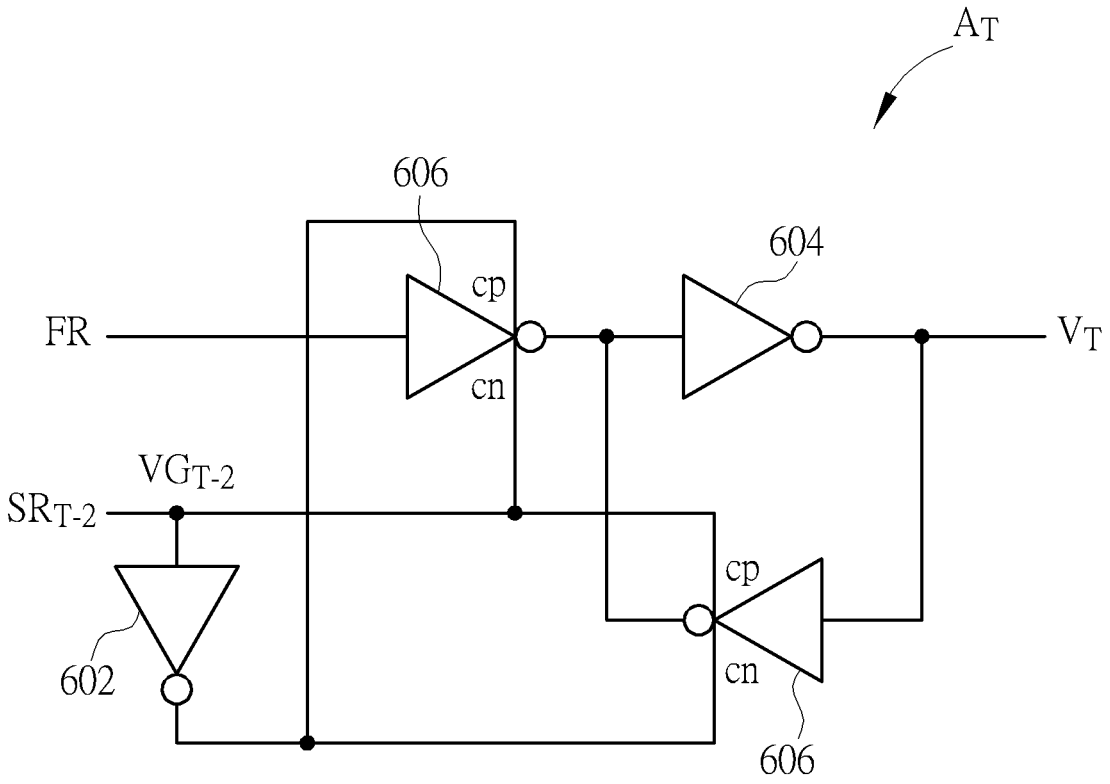
FIG. 8 is a circuit diagram of a common voltage generator in FIG. 4.
Figure 9:
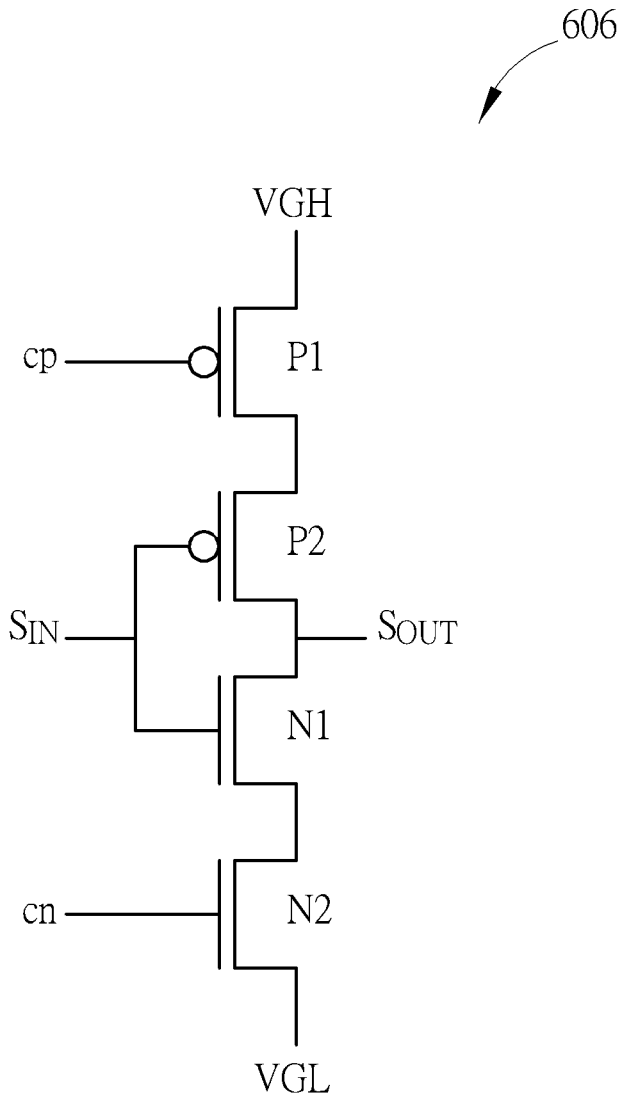
FIG. 9 is a circuit diagram of an inverting circuit in FIG. 8.

Please refer to FIGS. 8 and 9 with reference of FIG. 4. FIG. 8 is a circuit diagram of a common voltage generator $A_T$ in FIG. 4, and FIG. 9 is a circuit diagram of an inverting circuit 606 in FIG. 8, where T is a positive integer, and $1 \leq T \leq N$. The common voltage generator $A_T$ has two inverters 602 and 604 and two inverting circuits 606. The inverter 602 is configured to receive the gate signal $VG_{T-2}$ output from the $T^{th}$ shift register $SR_{T-2}$, and the input end of the inverter 604 is coupled to the output ends of the two inverting circuits 606. In an embodiment of the present invention, each of the inverting circuits 606 may comprise two P-type metal-oxide-semiconductor field effect transistors (PMOSFETs) P1 and P2 and two N-type metal-oxide-semiconductor field effect transistors (NMOSFETs) N1 and N2. The source of the PMOSFET P1 is coupled to a gate-high voltage level VGH, the gate of the PMOSFET P1 is coupled to a first control end cp of the inverting circuit 606, and the drain of the PMOSFET P1 is coupled to the source of the PMOS P2. The gate of the PMOSFET P2 and the gate of the NMOSFET N1 are coupled to an input end $S_{IN}$ of the inverting circuit 606, and the drain of the PMOSFET P2 and the drain of the NMOSFET N1 are coupled to an output end $S_{OUT}$ of the inverting circuit 606. The drain of the NMOSFET N2 is coupled to the source of the NMOSFET N1, the gate of the NMOSFET N2 is coupled to a second control end cn of the inverting circuit 606, and the source of the NMOSFET N2 is coupled to a gate-low voltage level VGL. Therefore, the common voltage generator $A_T$ may latch the gate signal $VG_{T-2}$ according to the clock signal FR so as to output the initial common voltage $V_T$.

Figure 10:
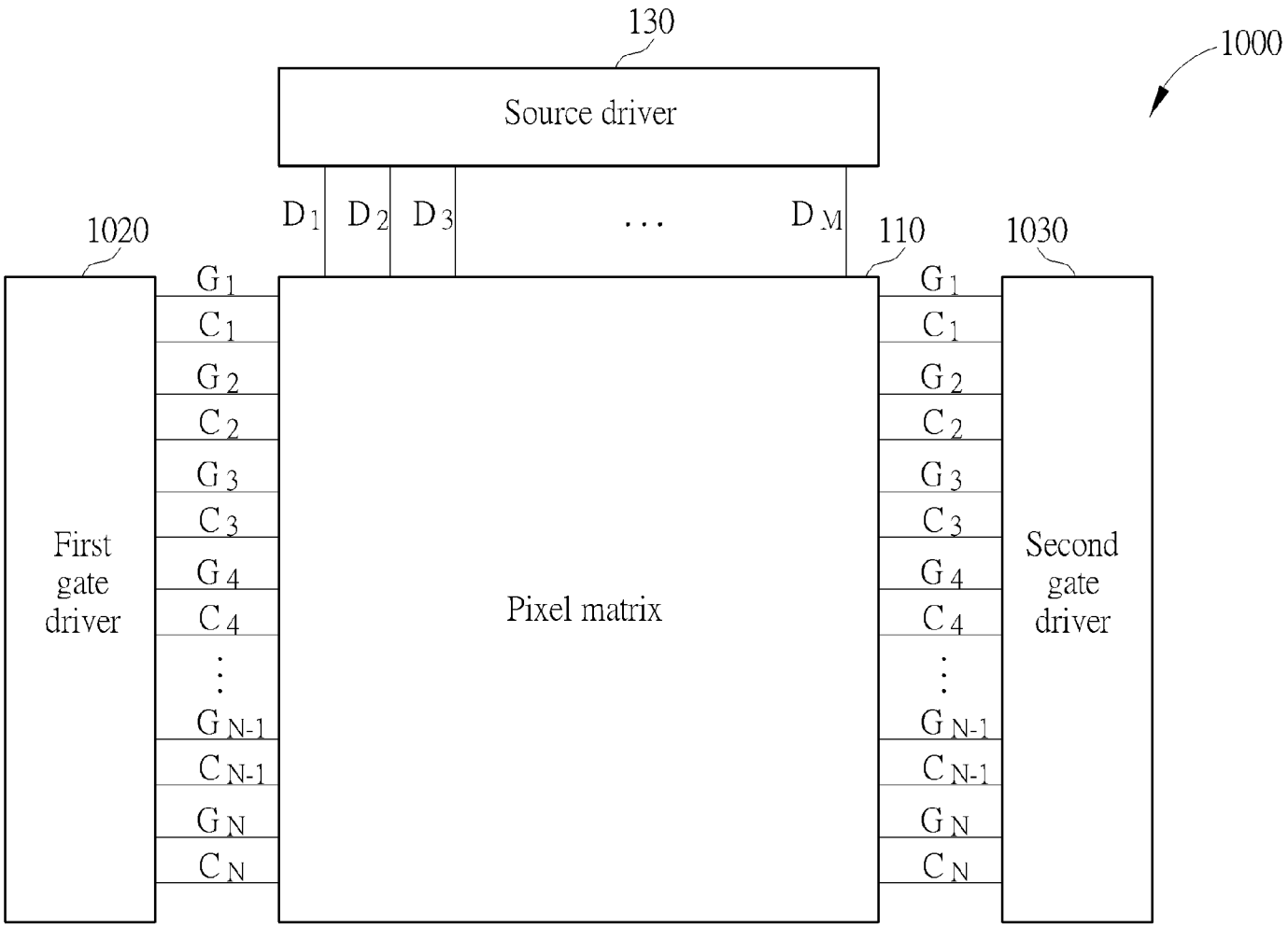
FIG. 10 is a schematic diagram of a liquid crystal display according to another embodiment of the present invention.
Figure 11:
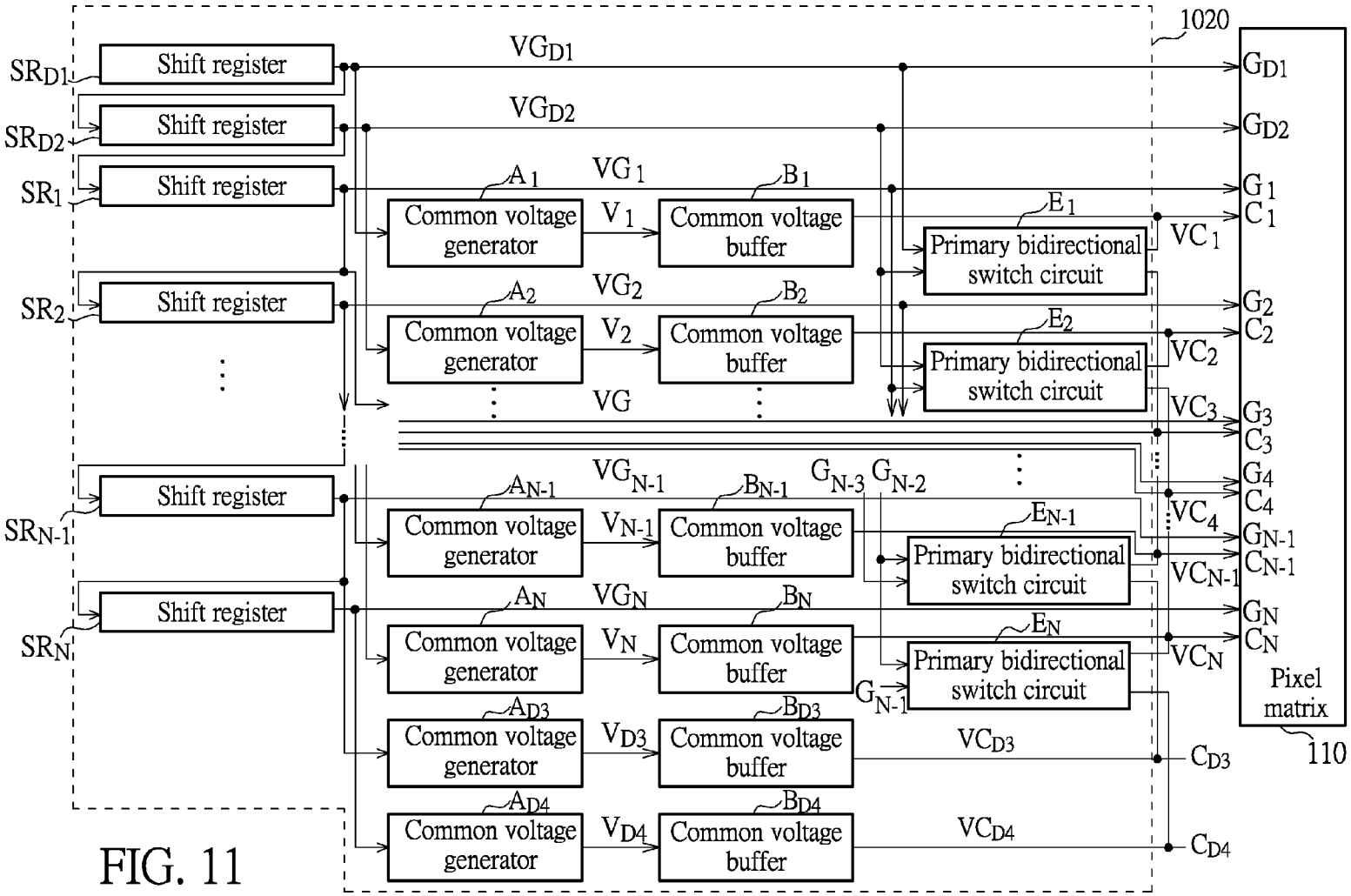
FIG. 11 is a schematic diagram of a pixel matrix and a first gate driver in FIG. 10.
Figure 12:
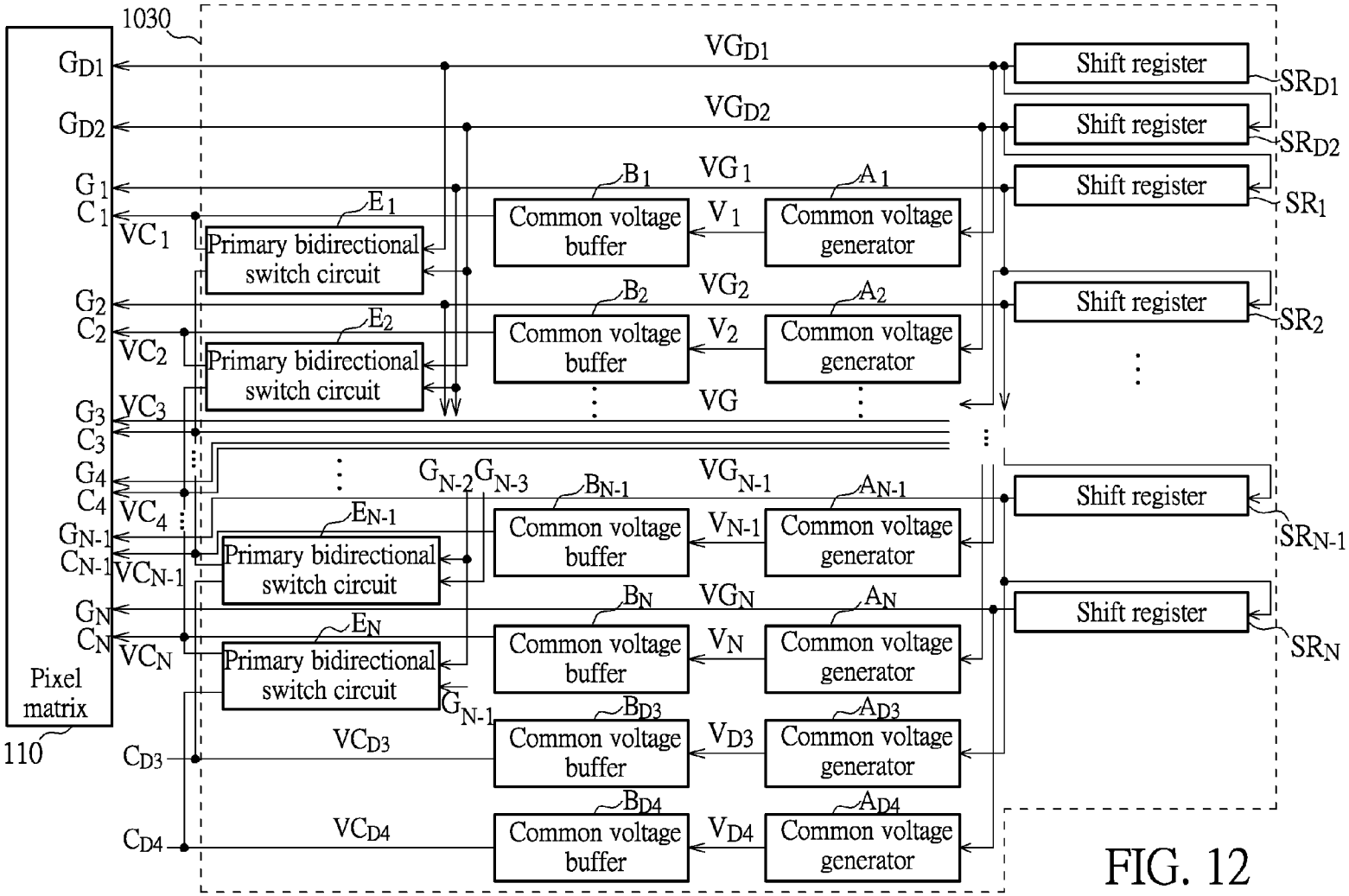
FIG. 12 is a schematic diagram of the pixel matrix and a second gate driver in FIG. 10.

In the above embodiments, the LCD 100 uses the single gate driver 120 to perform single-sided scanning operations. However, the present invention may be also adopted in an LCD that uses two gate drivers to perform double-sided scanning operations. Please refer to FIGS. 10 to 12. FIG. 10 is a schematic diagram of a liquid crystal display 1000 according to another embodiment of the present invention. FIG. 11 is a schematic diagram of a pixel matrix 110 and a first gate driver 1020 of the LCD 1000 in FIG. 10. FIG. 12 is a schematic diagram of the pixel matrix 110 and a second gate driver 1030 of the LCD 1000 in FIG. 10. The LCD 1000 comprises the pixel matrix 110, a first gate driver 1020, a second gate driver 1030 and the source driver 130. The first gate driver 1020 and the second gate driver 1030 are positioned at two opposite sides of the LCD 1000. The functions of the pixel matrix 110 and the source driver 130 has explained in the previous descriptions, and the circuit structure of the first gate driver 1020 is completely the same as that of the gate driver 120, and will thus not be repeated herein. Moreover, the circuit structure of the second gate driver 1030 is completely symmetrical with that of the first gate driver 1020, and the components of the second gate driver 1030 has the same functions as the components of the first gate driver 1020, which are configured to generate and output the gate signals $VG_1$ to $VG_N$ to the scan lines $G_1$ to $G_N$ and are configured to output the common voltages $VC_1$ to $VC_N$, $VC_{D3}$ and $VC_{D4}$ to the common voltage lines $C_1$ to $C_N$, $C_{D3}$ and $C_{D4}$. Since each of the scan lines $G_1$ to $G_N$ receives a corresponding one of the gate signals $VG_1$ to $VG_N$ from the first fate driver 1020 and the second gate driver 1030 positioned at the two opposite sides of the LCD 1000, and each of the common voltage lines $C_1$ to $C_N$ receives one of the common voltages $VC_1$ to $VC_N$ from the first fate driver 1020 and the second gate driver 1030, the image quality at the rims of the LCD 1000 is better than that of the LCD 100.

Figure 13:
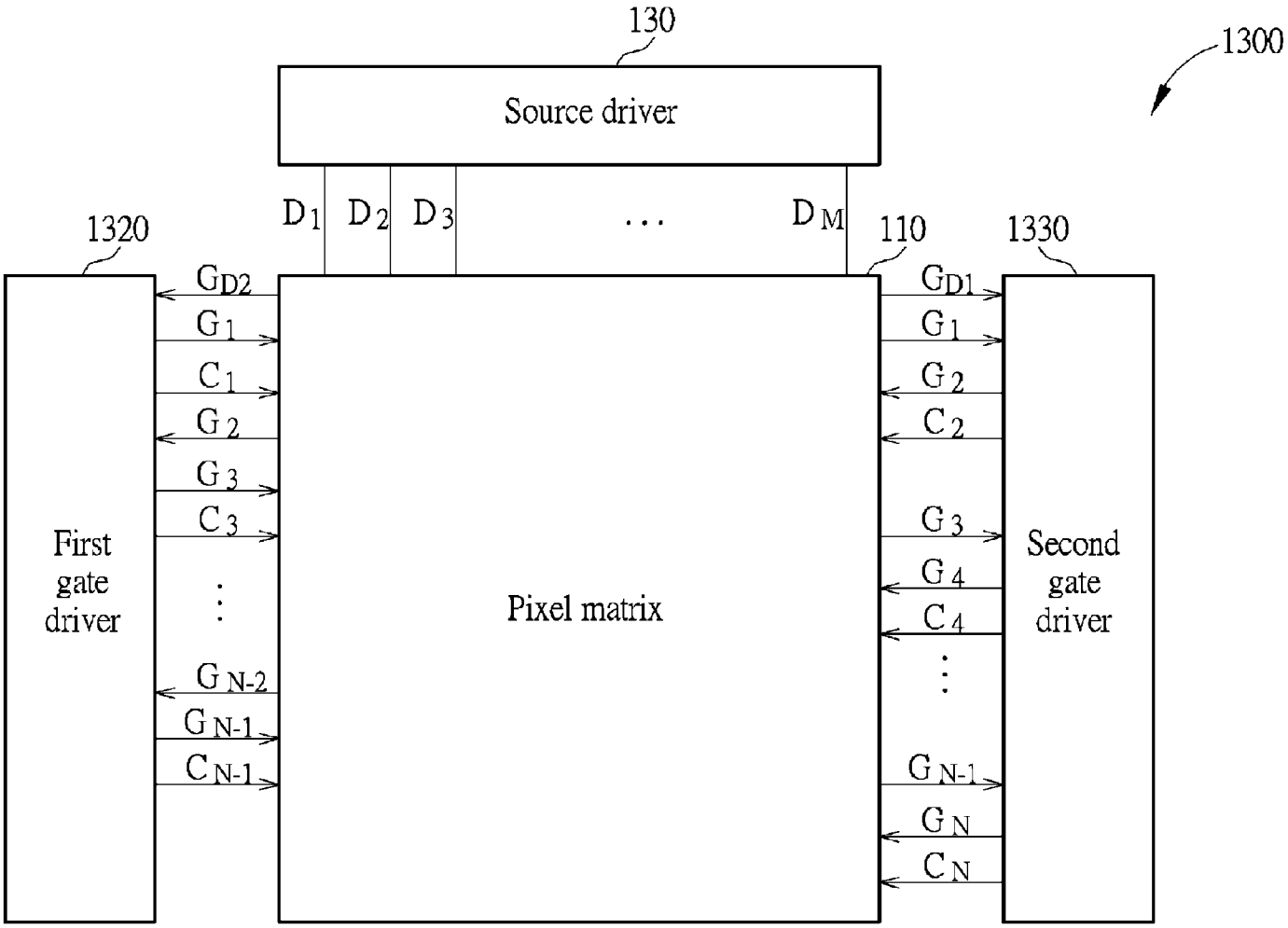
FIG. 13 is a schematic diagram of a liquid crystal display having a first gate driver and a second gate driver of the present invention.
Figure 14:
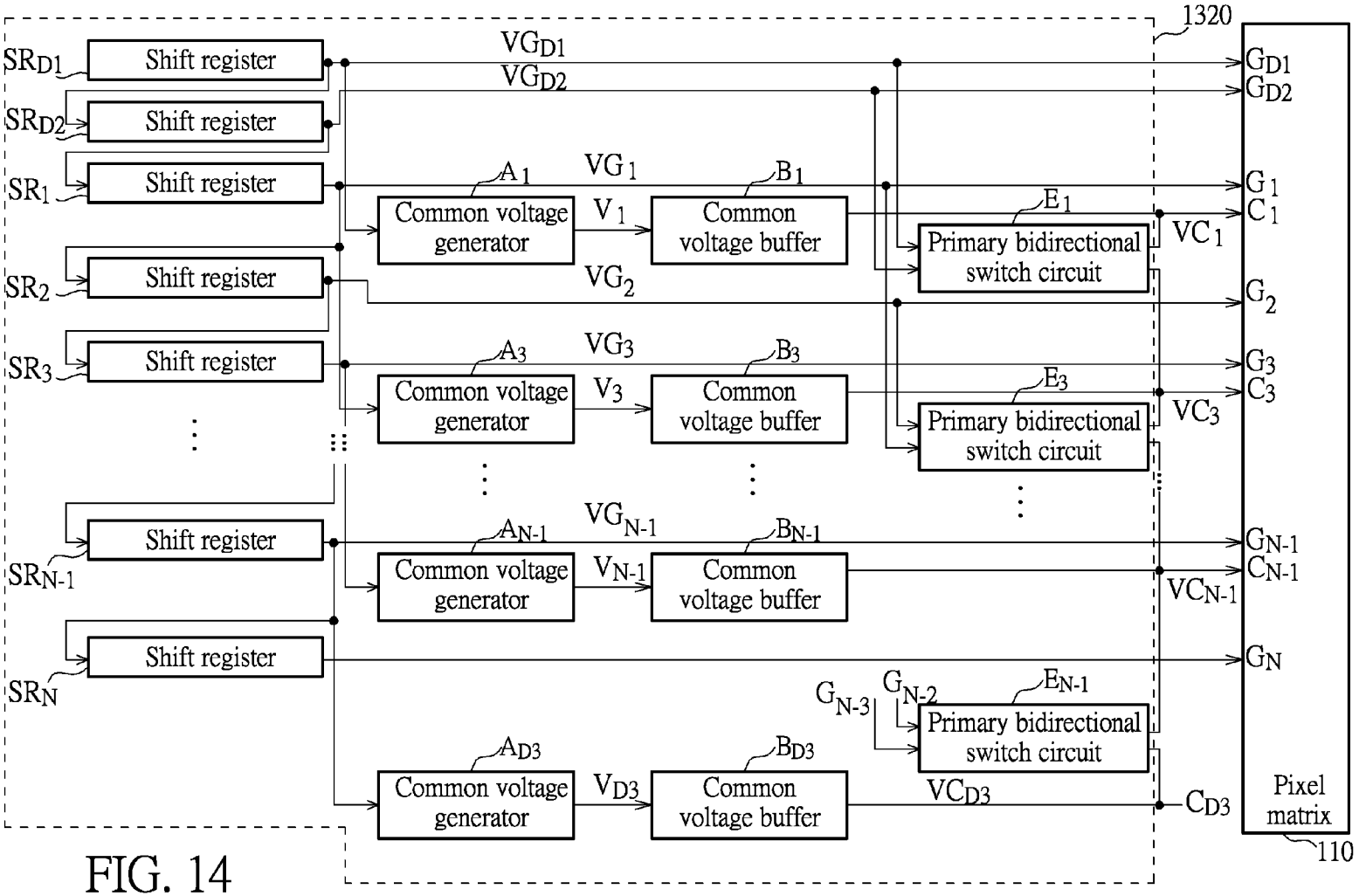
FIGS. 14 and 15 are schematic diagrams of the pixel matrix, the first gate driver and the second gate driver in FIG. 13 according to another embodiment of the present invention.
Figure 15:
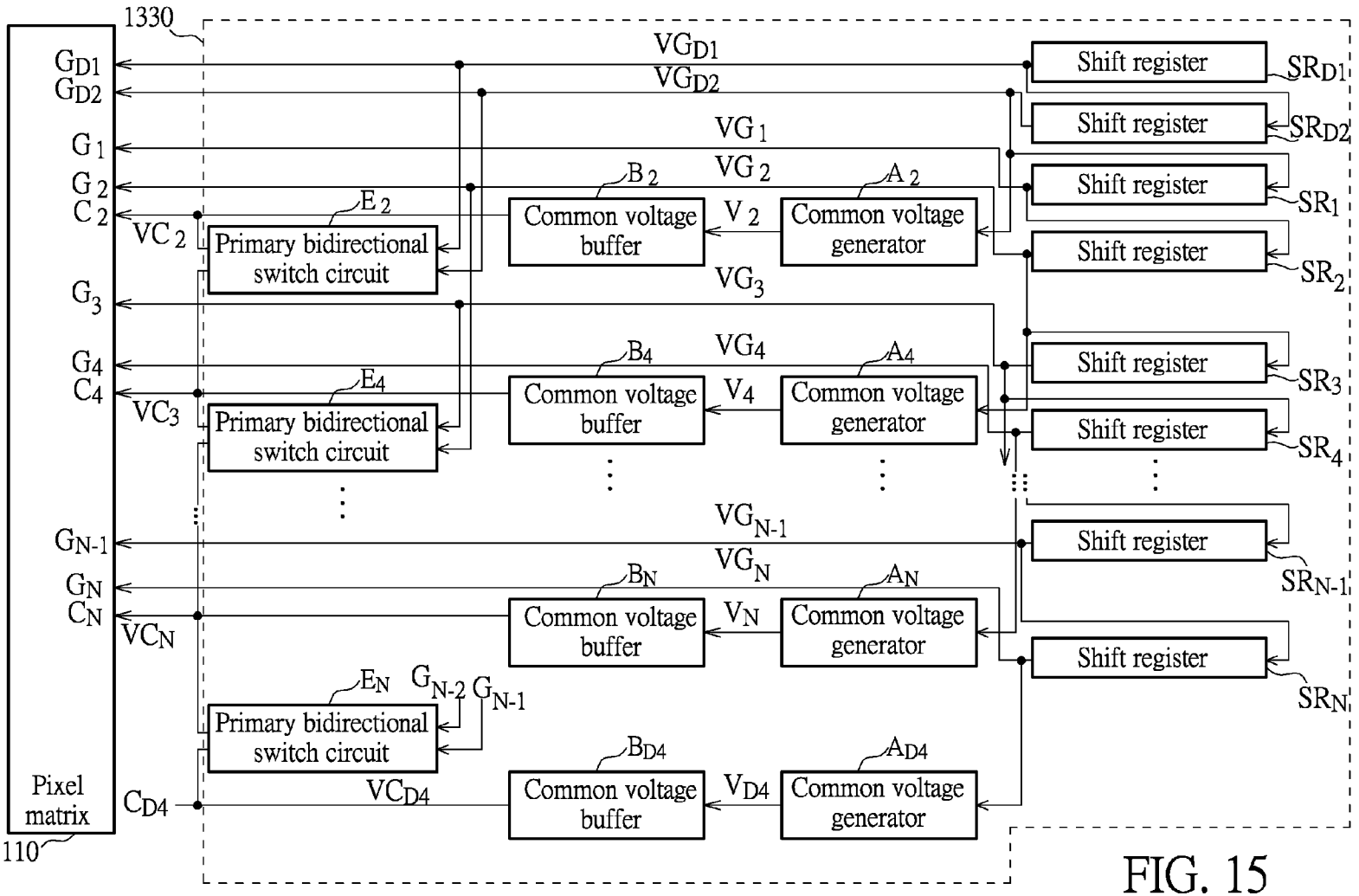

The LCD 100 uses a single gate driver to perform single-sided scanning operations, and the LCD 1000 uses two gate drivers to perform double-sided scanning operations. However, the present invention may be also adopted in an LCD that uses two gate drivers to perform single-sided scanning operations. Please refer to FIGS. 13 to 15. FIG. 13 is a schematic diagram of a liquid crystal display 1300 having a first gate driver 1320 and a second gate driver 1330 of the present invention. FIGS. 14 and 15 are schematic diagrams of the pixel matrix 110, the first gate driver 1320 and the second gate driver 1330 in FIG. 13 according to another embodiment of the present invention. The LCD 1300 comprises the pixel matrix 110, the first gate driver 1320, the second gate driver 1330 and the source driver 130. The first gate driver 1320 and the second gate driver 1330 are positioned at two opposite sides of the LCD 1300. The functions of the pixel matrix 110 and the source driver 130 have explained in the previous descriptions, and will thus not be repeated herein. In the embodiment, the common voltage generators $A_1$ to $A_N$, $A_{D3}$ and $A_{D4}$, the common voltage buffers $B_1$ to $B_N$, $B_{D3}$ and $B_{D4}$ and the primary bidirectional switch circuits $E_1$ to $E_N$ are divided into two parts, and each of the parts is integrated in one of the first gate driver 1320 and the second gate driver 1330 of the LCD 1300. In more detail, the odd-numbered common voltage generators $A_1, A_3, \ldots, A_{N-1}$ and $A_{D3}$, the odd-numbered common voltage buffers $B_1, B_3, \ldots, B_{N-1}$ and $B_{D3}$ and the odd-numbered common primary bidirectional switch circuits $E_1, E_3, \ldots$ and $E_{N-1}$ are integrated in the first gate driver 1320. The even-numbered common voltage generators $A_2, A_4, \ldots, A_N$ and $A_{D4}$, the even-numbered common voltage buffers $B_2, B_4, \ldots, B_N$ and $B_{D4}$ and the even-numbered common primary bidirectional switch circuits $E_2, E_4, \ldots$ and $E_N$ are integrated in the second gate driver 1330. Therefore, the first gate driver 1320 transmits the odd-numbered common voltages $VC_1, VC_3, \ldots$ and $VC_{N-1}$ to the pixel matrix 110 via the odd-numbered common voltage lines $C_1, C_3, \ldots$ and $C_{N-1}$, and the second gate driver 1330 transmits the even-numbered common voltages $VC_2, VC_4, \ldots$ and $VC_N$ to the pixel matrix 110 via the even-numbered common voltage lines $C_2, C_4, \ldots$ and $C_N$. Moreover, each of the first gate driver 1320 and the second gate driver 1330 has N+2 shift registers $SR_{D1}$, $SR_{D2}$ and $SR_1$ to $SR_N$ that are configured to sequentially output the gate signals $VG_{D1}$, $VG_{D2}$ and $VG_1$ to $VG_N$ to the scan lines $G_{D1}$, $G_{D2}$ and $G_1$ to $G_N$. The connections of the common voltage generators $A_1$ to $A_N$, $A_{D3}$ and $A_{D4}$, the common voltage buffers $B_1$ to $B_N$, $B_{D3}$ and $B_{D4}$, the primary bidirectional switch circuits $E_1$ to $E_N$, the scan lines $G_{D1}$, $G_{D2}$ and $G_1$ to $G_N$ and the common voltage lines $C_1$ to $C_N$, $C_{D3}$ and $C_{D4}$ of the LCD 1300 are the same as those of the LCD 100, and will thus not be repeated herein.

In an embodiment of the present invention, the number of shift registers of the first gate driver 1320 in FIG. 14 and the second gate driver 1330 in FIG. 15 may be reduced. For example, the first gate driver 1320 in FIG. 14 may be replaced by a first gate driver 1320B in FIG. 16, and the second gate driver 1320 in FIG. 15 may be replaced by a second gate driver 1330B in FIG. 17. Moreover, the primary bidirectional switch circuits $E_1$ to $E_N$ may be replaced by primary bidirectional switch circuits $E'_1$ to $E'_N$. Please refer to FIGS. 16 and 17. In the embodiment, the common voltage generators $A_1$ to $A_N$, $A_{D3}$ and $A_{D4}$, the common voltage buffers $B_1$ to $B_N$, $B_{D3}$ and $B_{D4}$ and the primary bidirectional switch circuits $E'_1$ to $E'_N$ are divided into two parts, and each of the parts is integrated in one of the first gate driver 1320B and the second gate driver 1330B. In more detail, the odd-numbered common voltage generators $A_1, A_3, \ldots, A_{N-1}$ and $A_{D3}$, the odd-numbered common voltage buffers $B_1, B_3, \ldots, B_{N-1}$ and $B_{D3}$ and the odd-numbered common primary bidirectional switch circuits $E'_1, E'_3, \ldots$ and $E'_{N-1}$ are integrated in the first gate driver 1320B. The even-numbered common voltage generators $A_2, A_4, \ldots, A_N$ and $A_{D4}$, the even-numbered common voltage buffers $B_2, B_4, \ldots, B_N$ and $B_{D4}$ and the even-numbered common primary bidirectional switch circuits $E'_2, E'_4, \ldots$ and $E'_N$ are integrated in the second gate driver 1330B.

Figure 16:
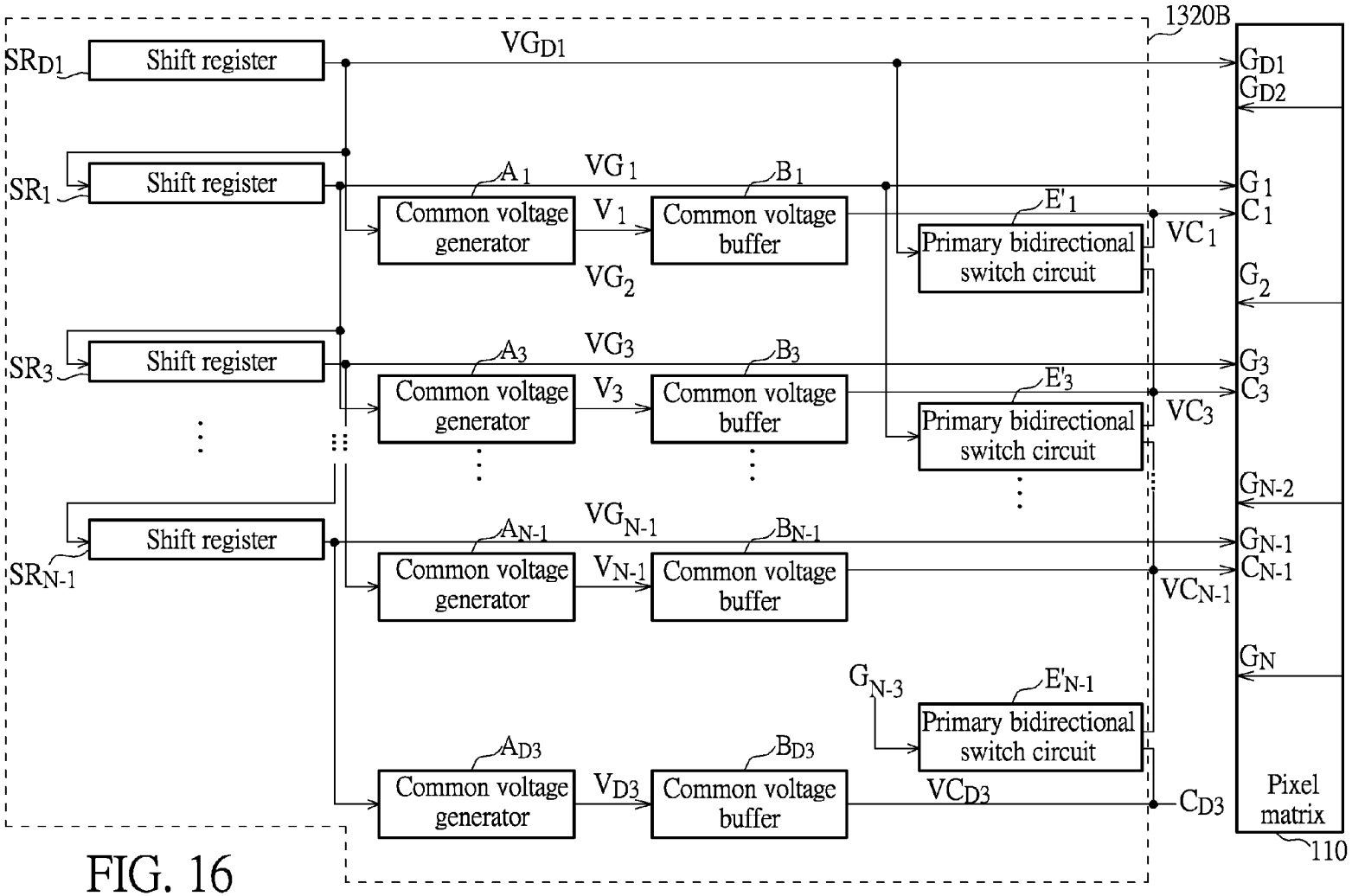
FIGS. 16 and 17 are schematic diagrams of the pixel matrix, the first gate driver and the second gate driver in FIG. 13 according to another embodiment of the present invention.
Figure 17:
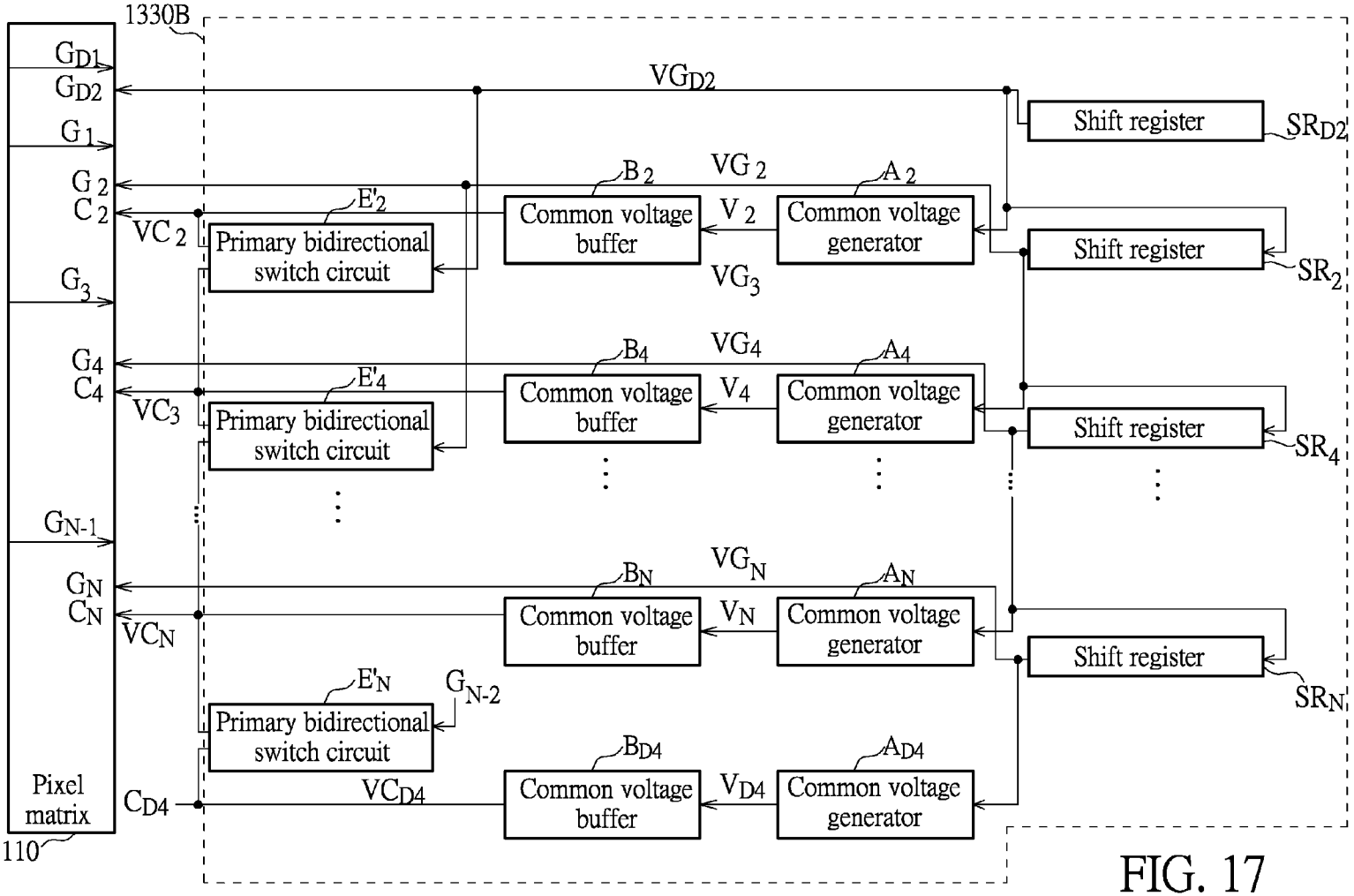
Figure 18:
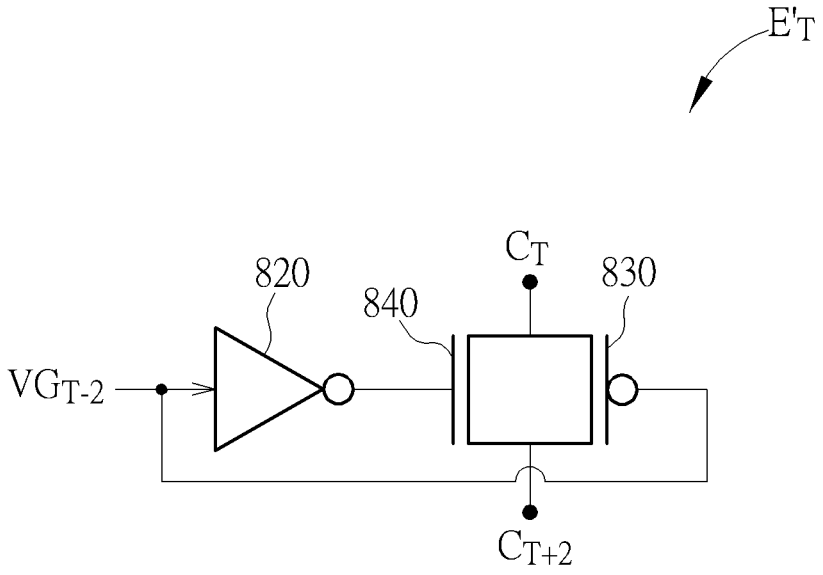
FIG. 18 is a circuit diagram of a primary bidirectional switch circuit in FIGS. 16 and 17.
Figure 19:
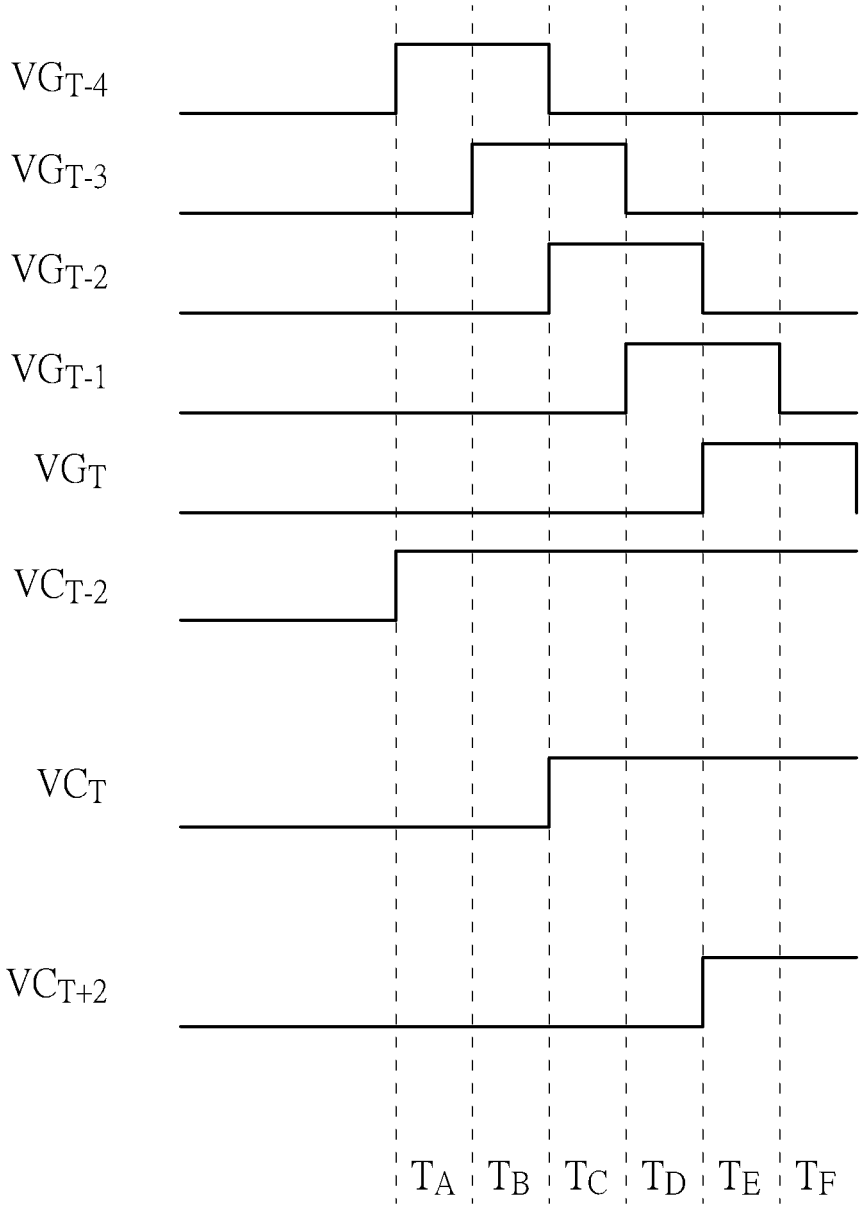
FIG. 19 is a timing diagram of the primary bidirectional switch in FIG. 18.

Please refer to FIGS. 18 and 19 with reference of FIGS. 16 and 17. FIG. 18 is a circuit diagram of a primary bidirectional switch circuit $E'_T$ in FIGS. 16 and 17. T is a positive integer, and $1 \leq T \leq N$. FIG. 19 is a timing diagram of the primary bidirectional switch $E'_T$ in FIG. 18. The gate signal $VG_{T-4}$ is at the high voltage level within the durations $T_A$ and $T_B$, the gate signal $VG_{T-3}$ is at the high voltage level within the durations $T_B$ and $T_C$, the gate signal $VG_{T-2}$ is at the high voltage level within the durations $T_C$ and $T_D$, the gate signal $VG_{T-1}$ is at the high voltage level within the durations $T_D$ and $T_E$, and the gate signal $VG_T$ is at the high voltage level within the durations $T_E$ and $T_F$. The primary bidirectional switch circuit $E'_T$ comprises an inverter 820, a first switch 830 and a second switch 840. The input end of the inverter 820 receives the gate signal $VG_{T-2}$. A first end of the first switch 830 is coupled to the common voltage line $C_T$, a second end of the first switch 830 is coupled to the common voltage line $C_{T+2}$, and a control end of the first switch 830 receives the gate signal $VG_{T-2}$. A first end of the second switch 840 is coupled to the first end of the first switch 830 and the common voltage line $C_T$, a second end of the second switch 840 is coupled to the second end of the first switch 830 and the common voltage line $C_{T+2}$, and a control end of the second switch 840 is coupled to an output end of the inverter 820. Therefore, when the gate signal $VG_{T-2}$ is at the high voltage level, the first switch 830 and the second switch 840 are turned off, and the common voltage line $C_T$ is electrically disconnected from the common voltage line $C_{T+2}$. When the gate signal $VG_{T-2}$ is at the low voltage level, the first switch 830 and the second switch 840 are turned on, and the common voltage line $C_T$ is electrically connected to the common voltage line $C_{T+2}$. In other words, the $T^{th}$ primary bidirectional switch circuit $E'_T$ controls the electrical connection between the $T^{th}$ common voltage line $C_T$ and the $T+2^{th}$ common voltage line $C_{T+2}$ of the common voltage lines $C_1$ to $C_N$, $C_{D3}$ and $C_{D4}$ according to the gate signal $VG_{T-2}$ output from the $T^{th}$ shift register $SR_{T-2}$ of the shift registers $SR_{D1}$, $SR_{D2}$ and $SR_1$ to $SR_N$. Therefore, the common voltage lines $C_T$ and $C_{T+2}$ share electric charge through the primary bidirectional switch circuit $E'_T$.

Figure 20:
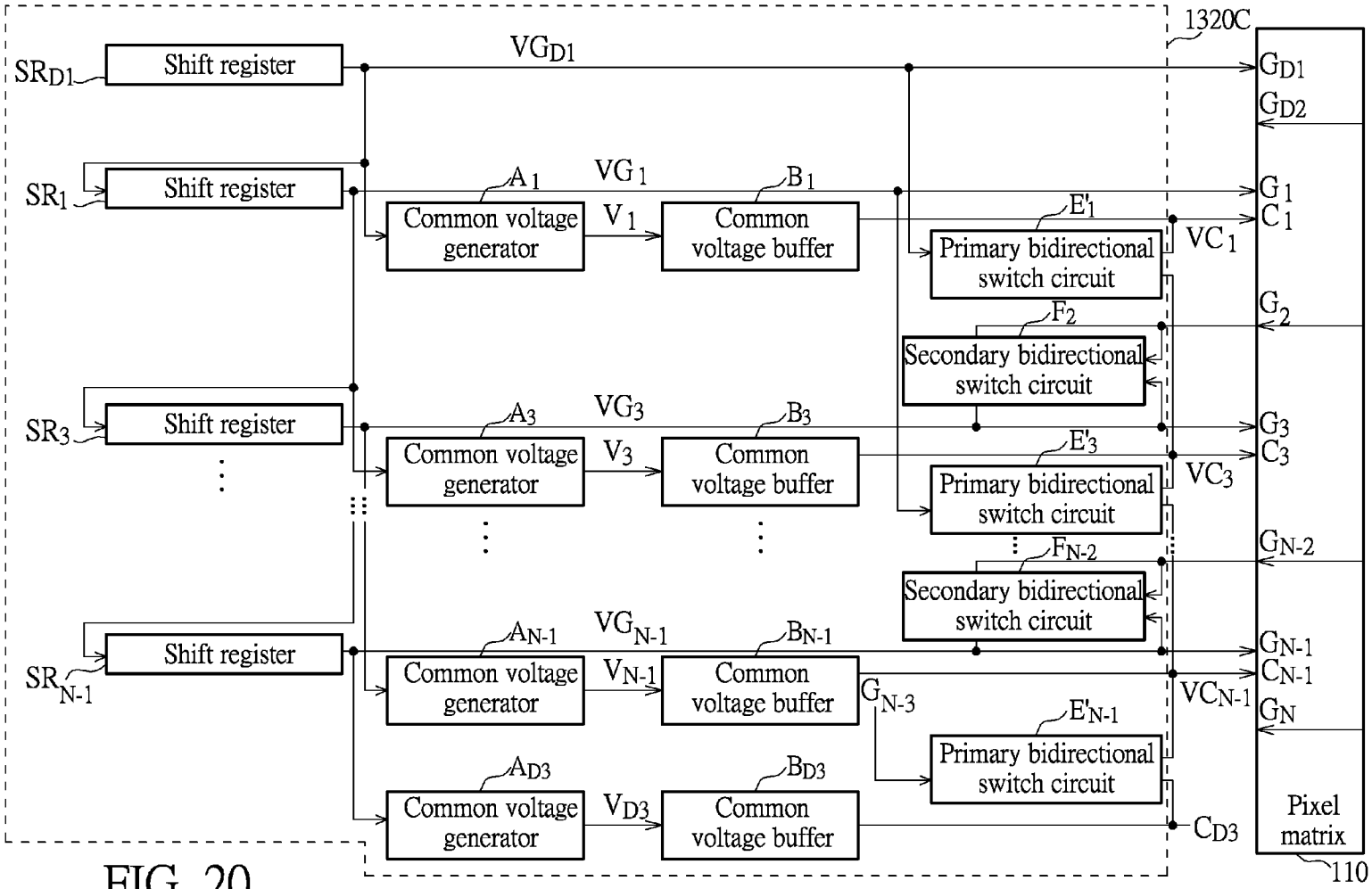
FIGS. 20 and 21 are schematic diagrams of the pixel matrix, the first gate driver and the second gate driver in FIG. 13 according to another embodiment of the present invention.
Figure 21:
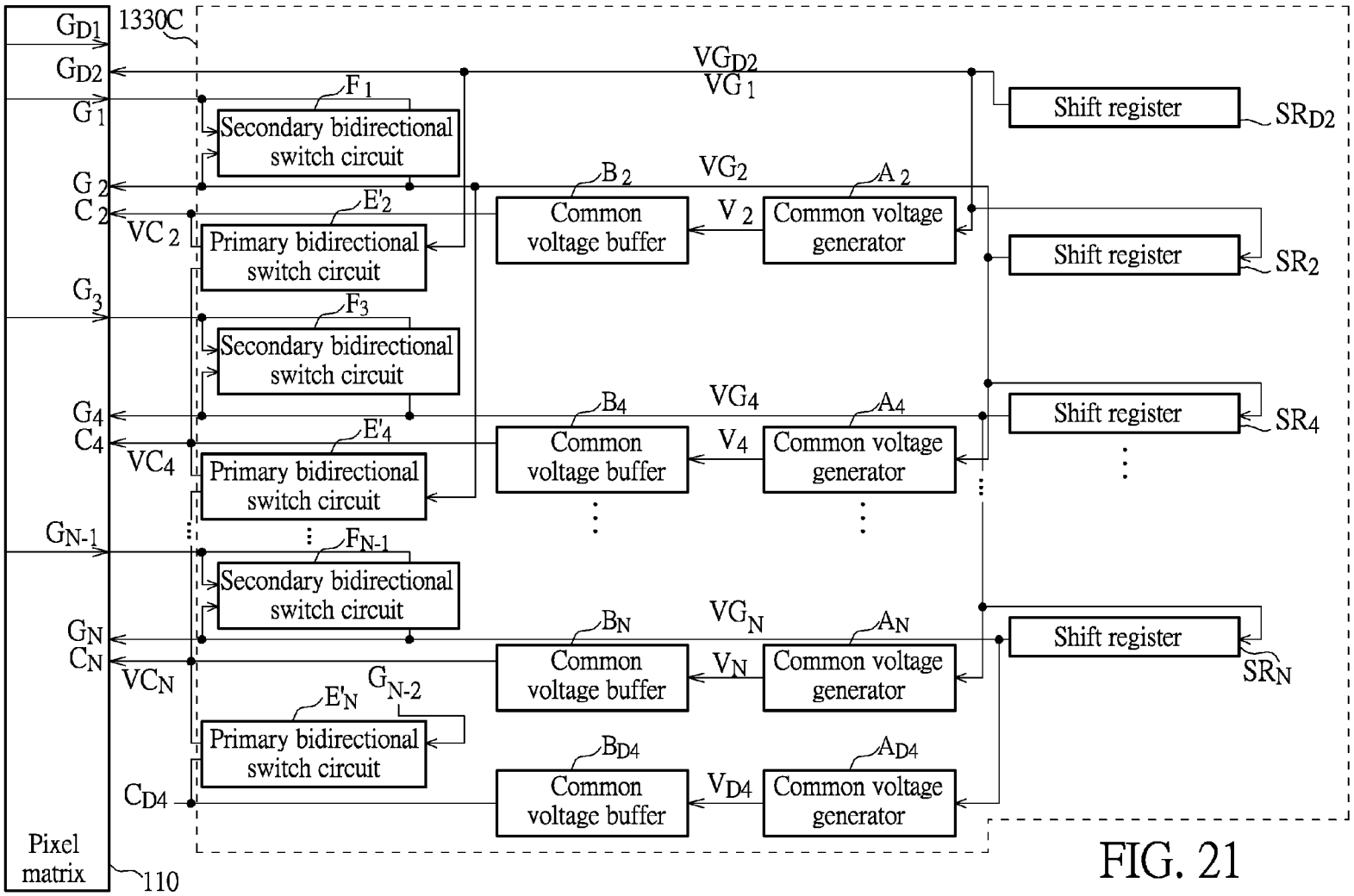

In an embodiment of the present invention, the first gate driver 1320B may be replaced by a first gate driver 1320C in FIG. 20, and the second gate driver 1320B may be replaced by a second gate driver 1330C in FIG. 21. As compared to the first gate driver 1320B and the second gate driver 1320B, the first gate driver 1320C and the second gate driver 1320C further comprise a plurality of secondary bidirectional switch circuits $F_1$ to $F_{N-1}$.

The even-numbered secondary bidirectional switch circuits $F_2$, $F_4$, . . . and $F_{N-2}$ of the secondary bidirectional switch circuits $F_1$ to $F_{N-1}$ are integrated in the first gate driver 1320C, the odd-numbered secondary bidirectional switch circuits $F_1$, $F_3$, . . . and $F_{N-1}$ of the secondary bidirectional switch circuits $F_1$ to $F_{N-1}$ are integrated in the second gate driver 1330C. The first gate driver 1320C and the second gate driver 1330C are positioned at two opposite sides of the liquid crystal display. The secondary bidirectional switch circuits $F_1$ to $F_{N-1}$ are coupled to the scan lines $G_1$ to $G_N$. Each of the secondary bidirectional switch circuits $F_1$ to $F_{N-1}$ controls the electric connection between two of the scan lines $G_1$ to $G_N$ according to two of the gate signals $VG_1$ to $VG_N$. For example, the secondary bidirectional switch circuits $F_1$ controls the electric connection between the scan lines $G_1$ and $G_2$ according to the gate signals $VG_1$ and $VG_2$; the secondary bidirectional switch circuits $F_2$ controls the electric connection between the scan lines $G_2$ and $G_3$ according to the gate signals $VG_2$ and $VG_3$; the secondary bidirectional switch circuits $F_3$ controls the electric connection between the scan lines $G_3$ and $G_4$ according to the gate signals $VG_3$ and $VG_4$; and so on.

Figure 22:
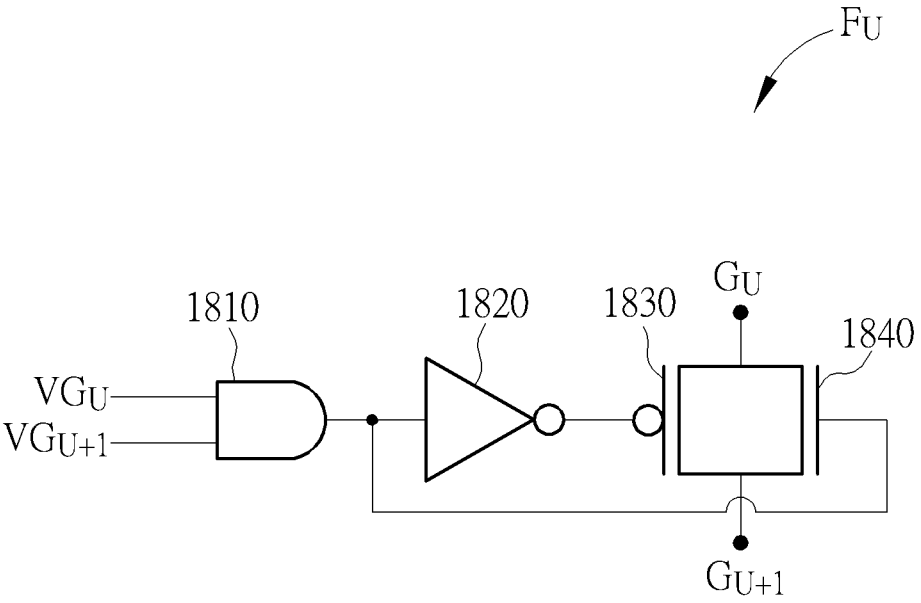
FIG. 22 is a circuit diagram of a secondary bidirectional switch circuit in FIGS. 20 and 21.

Please refer to FIG. 22 with reference of FIGS. 20 and 21. FIG. 22 is a circuit diagram of a secondary bidirectional switch circuit $F_U$ in FIGS. 20 and 21. U is a positive integer, and $1 \leq U \leq N-1$. The secondary bidirectional switch circuit $F_U$ comprises an AND gate 1810, an inverter 1820, a first switch 1830 and a second switch 1840. The AND gate 1810 has two input ends for receiving the gate signals $VG_U$ and $VG_{U+1}$ respectively from the shift registers $SR_U$ and $SR_{U+1}$. The AND gate 1810 performs a logic AND operation on the two gate signals $VG_U$ and $VG_{U+1}$. An input end of the inverter 1820 is coupled to an output end of the AND gate 1810. A first end of the first switch 1830 is coupled to the scan line $G_U$, a second end of the first switch 1830 is coupled to the scan line $G_{U+1}$, and a control end of the first switch 1830 is coupled to the output end of the inverter 1820. A first end of the second switch 1840 is coupled to the first end of the first switch 1830, a second end of the second switch 1840 is coupled to the second end of the first switch 1830 and the scan line $G_{U+1}$, and a control end of the second switch 1840 is coupled to the output end of the AND gate 1810. Therefore, when the gate signals $VG_U$ and $VG_{U+1}$ are at the high voltage level, the first switch 1830 and the second switch 1840 are turned on, such that the scan line $G_U$ is electrically connected to the scan line $G_{U+1}$. When the gate signals $VG_U$ and $VG_{U+1}$ are not both at the high voltage level, the first switch 1830 and the second switch 1840 are turned off, such that the scan line $G_U$ is electrically disconnected from the scan line $G_{U+1}$. In other words, the $U^{th}$ secondary bidirectional switch circuit $F_U$ of the secondary bidirectional switch circuits $F_1$ to $F_{N-1}$ controls the electric connection between the $U^{th}$ scan line $G_U$ and the $U+1^{th}$ scan line $G_{U+1}$ of the scan lines $G_1$ to $G_N$ according to the gate signals $VG_U$ and $VG_{U+1}$ output from the $U+2^{th}$ shift resister $SR_U$ and the $U+3^{th}$ shift resister $SR_{U+1}$.

In the first gate driver 1320C, due to the even-numbered secondary bidirectional switch circuits $F_2$, $F_4$, . . . and $F_{N-2}$, the gate signals $VG_1$, $VG_3$, . . . and $VG_{N-1}$ generated by the first gate driver 1320C may compensate the gate signals $VG_2$, $VG_4$, . . . and $VG_{N-2}$. Similarly, due to the odd-numbered secondary bidirectional switch circuits $F_1$, $F_3$, . . . and $F_{N-1}$ of the second gate driver 1330C, the gate signals $VG_2$, $VG_4$, . . . and $VG_N$ generated by the second gate driver 1330C may compensate the gate signals $VG_1$, $VG_3$, . . . and $VG_{N-1}$. Therefore, the signals at the ends of the scan lines $G_1$ to $G_{N-1}$ may be strengthened through the secondary bidirectional switch circuits $F_1$ to $F_{N-1}$, such that the image quality of the LCD may be ensured.

According to the embodiments of the present invention, with the help of primary bidirectional switch circuits, the LCD may control electrical connections of the common voltage lines according to timing of polarity inversion of each row of pixel. Accordingly, electric charge of each common voltage line may be shared to other common voltage lines, and an equivalent capacitance of pixels driven by the common voltage buffers may be not too great. Since the equivalent capacitance of pixels driven by the common voltage buffers may be not too great, the layout area of the common voltage buffers may be reduced to contribute to the achievement of the narrow bezel design of the display panel.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display (LCD), comprising:

a pixel matrix, comprising:

a plurality of pixels, arranged in a plurality of rows;

a plurality of scan lines, each of the scan lines being coupled to pixels arranged in one of the rows; and a plurality of common voltage lines, each of the common voltage lines being coupled to the pixels arranged in one of the rows;

a plurality of shift registers, coupled to the scan lines and configured to sequentially output gate signals to the scan lines;

a plurality of common voltage generators, coupled between the shift registers and the common voltage lines and configured to output initial common voltages according to the gate signals; and a plurality of primary bidirectional switch circuits, coupled to the shift registers and the common voltage lines, wherein each of the primary bidirectional switch circuits is configured to control electrical connection between two of the common voltage lines according to at least one of the gate signals output from the shift registers;

wherein the pixels are arranged in N rows, the shift registers comprise N+2 first shift registers, and the primary bidirectional switch circuits comprise N first primary bidirectional switch circuits, wherein a $T^{th}$ one of the first primary bidirectional switch circuits is configured to control electrical connection between a $T^{th}$ one and $T+2^{th}$ one of the common voltage lines according to two gate signals output from a $T^{th}$ one and $T+1^{th}$ one of the first shift registers, N is an integer greater than 1, T is an integer, and $1 \leq T \leq N$.

2. The liquid crystal display of claim 1, wherein a first one and a second one of the first shift registers are dummy first shift registers.

3. The liquid crystal display of claim 1, wherein odd-numbered primary bidirectional switch circuits of the primary bidirectional switch circuits are integrated in a first gate driver of the liquid crystal display, even-numbered primary bidirectional switch circuits of the primary bidirectional switch circuits are integrated in a second gate driver of the liquid crystal display, and the first gate driver and the second gate driver are positioned at two sides of the liquid crystal display.

4. The liquid crystal display of claim 1 further comprising a plurality of common voltage buffers, coupled between the common voltage generators and the common voltage lines, and configured to buffer the initial common voltages so as to output a plurality of common voltages to the common voltage lines.

5. The liquid crystal display of claim 1, wherein each of the primary bidirectional switch circuits is configured to control the electrical connection between two of the common voltage lines according a gate signal output from a single one of the shift registers.

6. The liquid crystal display of claim 1, wherein the shift registers further comprise N+2 second shift registers, and the primary bidirectional switch circuits further comprise N second primary bidirectional switch circuits, wherein a $T^{th}$ one of the second primary bidirectional switch circuits is configured to control electrical connection between a $T^{th}$ one and $T+2^{th}$ one of the common voltage lines according to two gate signals output from a $T^{th}$ one and $T+1^{th}$ one of the second shift registers.

7. The liquid crystal display of claim 6, wherein a first one and a second one of the second shift registers are dummy first shift registers.

8. The liquid crystal display of claim 6, wherein the N+2 first shift registers and the N first primary bidirectional switch circuits are integrated in a first gate driver of the liquid crystal display, the N+2 second shift registers and the N second primary bidirectional switch circuits are integrated in a second gate driver of the liquid crystal display, and the first gate driver and the second gate driver are positioned at two sides of the liquid crystal display.

9. The liquid crystal display of claim 1, wherein each of the primary bidirectional switch circuits is configured to control the electrical connection between two of the common voltage lines according to two of the gate signals output from two of the shift registers.

10. The liquid crystal display of claim 9, wherein each of the primary bidirectional switch circuits comprises:

a NOR gate, having two input ends configured to receive the two gate signals output from the two shift registers;

an inverter, having an input end coupled to an output end of the NOR gate;

a first switch, a first end of the first switch being coupled to one of the two common voltage lines, a second end of the first switch being coupled to another of the two common voltage lines, and a control end of the first switch being coupled to an output end of the inverter; and a second switch, a first end of the second switch being coupled to the first end of the first switch, a second end of the second switch being coupled to the second end of the first switch, and a control end of the second switch being coupled to the output end of the NOR gate.

11. The liquid crystal display of claim 9, wherein each of the primary bidirectional switch circuits comprises:

an inverter, having an input end for receiving the gate signal output from the single one of the shift registers;

a first switch, a first end of the first switch being coupled to one of the two common voltage lines, a second end of the first switch being coupled to another of the two common voltage lines, and a control end of the first switch receiving the gate signal output from the single one of the shift registers; and a second switch, a first end of the second switch being coupled to the first end of the first switch, a second end of the second switch being coupled to the second end of the first switch, and a control end of the second switch being coupled to an output end of the inverter.

12. The liquid crystal display of claim 1 further comprising a plurality of secondary bidirectional switch circuits coupled to the scan lines, wherein each of the secondary bidirectional switch circuits is configured to control electrical connection between two of the scan lines according to two of the gate signals output from two neighboring shift registers of the shift registers.

13. The liquid crystal display of claim 12, wherein each of the secondary bidirectional switch circuits comprises:

an AND gate, having two input ends configured to receive the two gate signals output from the two neighboring shift registers;

an inverter, having an input end coupled to an output end of the AND gate;

a first switch, a first end of the first switch being coupled to one of the two scan lines, a second end of the first switch being coupled to another of the two scan lines, and a control end of the first switch being coupled to an output end of the inverter; and a second switch, a first end of the second switch being coupled to the first end of the first switch, a second end of the second switch being coupled to the second end of the first switch, and a control end of the second switch being coupled to the output end of the AND gate.

14. The liquid crystal display of claim 12, wherein a number of the secondary bidirectional switch circuits is equal to N−1, wherein a $U^{th}$ one of the second primary bidirectional switch circuits is configured to control electrical connection between a $U^{th}$ one and $U+1^{th}$ one of the scan lines according to two gate signals output from a $U+2^{th}$ one and $U+3^{th}$ one of the shift registers, U is an integer, and $1 \leq U \leq N-1$.

15. The liquid crystal display of claim 14, wherein even-numbered secondary bidirectional switch circuits of the secondary bidirectional switch circuits are integrated in a first gate driver of the liquid crystal display, odd-numbered secondary bidirectional switch circuits of the secondary bidirectional switch circuits are integrated in a second gate driver of the liquid crystal display, and the first gate driver and the second gate driver are positioned at two sides of the liquid crystal display.

* * * * *